US009775763B2

(12) United States Patent
Aleksov et al.

(10) Patent No.: US 9,775,763 B2
(45) Date of Patent: Oct. 3, 2017

(54) ADAPTIVE EXOSKELETON, CONTROL SYSTEM AND METHODS USING THE SAME

(71) Applicant: Intel Corporation, Santa Clara, CA (US)

(72) Inventors: Aleksandar Aleksov, Chandler, AZ (US); Brian S. Doyle, Portland, OR (US); Ravindranath V. Mahajan, Chandler, AZ (US)

(73) Assignee: INTEL CORPORATION, Santa Clara, CA (US)

( * ) Notice: Subject to any disclaimer, the term of this patent is extended or adjusted under 35 U.S.C. 154(b) by 880 days.

(21) Appl. No.: 13/719,336

(22) Filed: Dec. 19, 2012

(65) Prior Publication Data

US 2014/0171838 A1 Jun. 19, 2014

(51) Int. Cl.
*A61H 1/02* (2006.01)
*A61H 3/00* (2006.01)

(52) U.S. Cl.
CPC ..... *A61H 1/024* (2013.01); *A61H 1/0244* (2013.01); *A61H 1/0266* (2013.01); *A61H 1/0277* (2013.01); *A61H 1/0281* (2013.01); *A61H 1/0285* (2013.01); *A61H 1/0288* (2013.01); *A61H 1/0296* (2013.01); *A61H 3/00* (2013.01); *A61H 2201/164* (2013.01); *A61H 2201/165* (2013.01); *A61H 2201/1609* (2013.01);

(Continued)

(58) Field of Classification Search
CPC ..... A61N 1/04; A61N 1/0404; A61N 1/0452; A61N 1/0472; A61N 1/0484; G06F 3/015; G06F 3/061; A61F 2/50; A61F 2/68; G06N 3/061
USPC ..... 607/3, 45
See application file for complete search history.

(56) References Cited

U.S. PATENT DOCUMENTS 5,070,873 A * 12/1991 Graupe ..... A61N 1/36003 607/48
5,549,656 A * 8/1996 Reiss ..... A61N 1/36003 600/546

(Continued)

OTHER PUBLICATIONS

International Search Report and Written Opinion received for PCT Patent Application No. PCT/US2013/075899, mailed on Apr. 15, 2014, 16 pages.

(Continued)

*Primary Examiner* — Justine Yu
*Assistant Examiner* — Michael Tsai
(74) *Attorney, Agent, or Firm* — Grossman, Tucker, Perreault & Pfleger, PLLC

(57) ABSTRACT

Exoskeleton technology is described herein. Such technology includes but is not limited to exoskeletons, exoskeleton controllers, methods for controlling an exoskeleton, and combinations thereof. The exoskeleton technology may facilitate, enhance, and/or supplant the natural mobility of a user via a combination of sensor elements, processing/control elements, and actuating elements. User movement may be elicited by electrical stimulation of the user's muscles, actuation of one or more mechanical components, or a combination thereof. In some embodiments, the exoskeleton technology may adjust in response to measured inputs, such as motions or electrical signals produced by a user. In this way, the exoskeleton technology may interpret known inputs and learn new inputs, which may lead to a more seamless user experience.

25 Claims, 7 Drawing Sheets

(52) U.S. Cl.
CPC ..... *A61H 2201/1614* (2013.01); *A61H 2201/1628* (2013.01); *A61H 2201/1635* (2013.01); *A61H 2201/501* (2013.01); *A61H 2201/5002* (2013.01); *A61H 2201/5097* (2013.01); *A61H 2230/605* (2013.01)

(56) References Cited

U.S. PATENT DOCUMENTS

| | | | | |
|---|---|---|---|---|
| 7,381,192 | B2 * | 6/2008 | Brodard | A61H 1/0255 601/33 |
| 7,470,236 | B1 * | 12/2008 | Kelleher | A61B 5/04001 600/554 |
| 7,901,368 | B2 * | 3/2011 | Flaherty | A61H 1/0255 601/33 |
| 2002/0198604 | A1 | 12/2002 | Schulman | |
| 2006/0167564 | A1 * | 7/2006 | Flaherty | A61B 5/0476 623/57 |
| 2006/0206167 | A1 | 9/2006 | Flaherty et al. | |
| 2008/0009771 | A1 | 1/2008 | Perry et al. | |
| 2008/0161883 | A1 | 7/2008 | Conor | |
| 2010/0280628 | A1 * | 11/2010 | Sankai | A61B 5/04888 623/25 |

OTHER PUBLICATIONS

Firestone et al., "Design and Implementation of the XOS2 Exoskeleton for the United States Military", University of Pittsburgh, Swanson School of Engineer, Apr. 14, 2002, 11 pages.
Taiwan Office Action and Search Report from related case TW102143018, mailed Dec. 21, 2015.
International Report on Patentability received for PCT Patent Application No. PCT/US2013/075899, mailed on Jun. 23, 2015.
Examination Report received for Great Brittan Application GB1510004.3 mailed Jul. 16, 2015.
Chinese Office Action issued in corresponding Chinese Application No. 201380060270.5, dated Aug. 29, 2016.
Taiwan Office Action from related matter TW102143018, dated Aug. 18, 2016.
Chinese Office Action issued in corresponding Chinese Application No. 201380060270.5, dated Jan. 25, 2016.

* cited by examiner

Front View

Side View

Back View

Front
View

Side View

Back View

ADAPTIVE EXOSKELETON, CONTROL SYSTEM AND METHODS USING THE SAME

FIELD

The present disclosure generally relates to exoskeletons, exoskeleton controllers, and methods for controlling exoskeletons.

BACKGROUND

Many people suffer from limited mobility, which may result from age, disease, traumatic injury, or another cause. For example, a person may lose bone, muscle mass, and/or strength as he/she ages. As a result, his/her mobility may become increasingly limited over time. In other cases, a person may suffer traumatic injury that limits his/her mobility, e.g., by damaging/destroying muscle, bone and/or nerve pathways between the brain and a limb such as an arm or leg. For these and other reasons, a person may be mentally willing to move, but may be physically unable to do so.

Over the years, many technologies have been developed to enhance and/or restore human mobility that has been lost due to age and/or traumatic injury. In particular, interest has grown in the use of exoskeleton technology for enhancing and/or augmenting human mobility.

Exoskeleton technology has been developed in the military context to enhance the capabilities of soldiers and support personnel. Such military exoskeletons may include a steel and aluminum main frame having one or more hydraulically articulating joints that are generally configured to mimic the function of a major joint of a human (e.g., a knee, an elbow, a shoulder, etc.). Sensors and actuators attached to the main frame detect force applied by an operator (e.g., by the motion of the operator). In response to such applied force, a relevant portion of the exoskeleton moves in an appropriate manner. Thus, if an operator applies force to a sensor by moving one or his or her arms, a corresponding arm of the exoskeleton may move in an appropriate manner so as to mimic the motion of the operators arm.

Exoskeletons have also been developed for medicinal and therapeutic applications. In some instances, such exoskeletons may include "legs" that are formed by a metal main frame with articulating knee joints. After a user dons the exoskeleton, a therapist may utilize a control system to cause the exoskeleton to walk in a manner simulating the natural gait of a human being. In some instances, a user may take control when the exoskeleton takes steps, e.g., by pressing buttons in a handheld walker/cane. Alternatively or additionally, a user may prompt the exoskeleton to step by shifting his or her weight in a manner that is detectable by a force sensor.

While existing exoskeletons are useful, they often enhance or supplant a natural body motion of a user with the actuation of mechanical components, such as a mechanical joint that is strapped or otherwise attached to the body. Such exoskeletons may not enhance and/or restore motility by facilitating or enabling the contraction of a user's muscles. Moreover, existing exoskeletons often rely on force sensors and/or one or more buttons to initiate exoskeletal motion. That is, movement of such exoskeletons may be initiated in response to a button press or a motion made by a user that applies a detectable force on a force sensor. If the user cannot make the required movement or apply the necessary force, the exoskeleton may not respond.

BRIEF DESCRIPTION OF THE DRAWINGS

Features and advantages of embodiments of the claimed subject matter will become apparent as the following Detailed Description proceeds, and upon reference to the Drawings, wherein like numerals depict like parts, and in which:

Figures 1A, 1B, 1C:
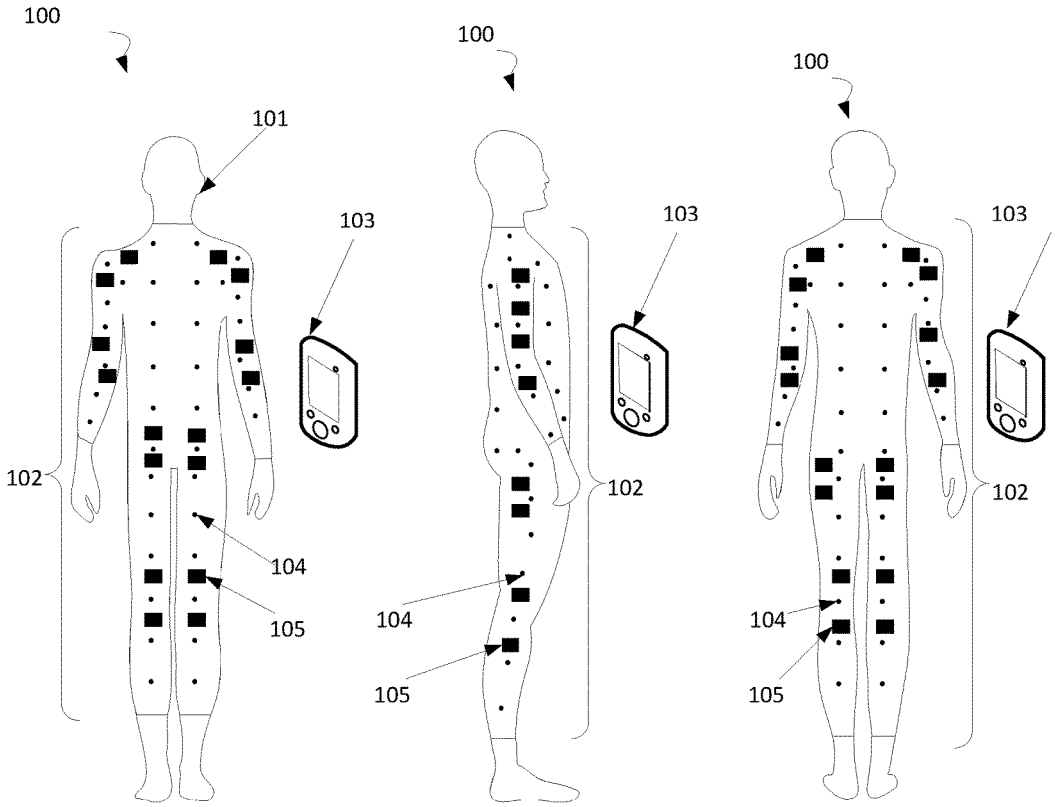
FIGS. 1A, 1B, and 1C depict front, side, and back views, respectively, of an exemplary exoskeleton in accordance with the present disclosure, as worn by a user.

Although the following detailed description will proceed with reference being made to illustrative embodiments, many alternatives, modifications, and variations thereof will be apparent to those skilled in the art.

DETAILED DESCRIPTION

While the present disclosure is described herein with reference to illustrative embodiments for particular applications, it should be understood that such embodiments are exemplary only and that the invention as defined by the appended claims is not limited thereto. Those skilled in the relevant art(s) with access to the teachings provided herein will recognize additional modifications, applications, and embodiments within the scope of this disclosure, and additional fields in which embodiments of the present disclosure would be of utility.

Described herein is exoskeleton technology that may cause, assist, and/or supplant the natural mobility of a user. Such exoskeleton technology includes but is not limited to exoskeletons, exoskeleton controllers, methods for controlling an exoskeleton, and combinations thereof. As will be explained in detail below, the exoskeleton technology described herein may utilize a combination of sensor elements, processing/control elements, and actuating elements to enable and/or assist a user to move in a desired manner. Such movement may be elicited through electrical stimulation of the user's muscles, actuation of one or more mechanical components, or a combination thereof. In some embodiments, the exoskeleton technology may adjust in response to measured inputs, such as motions or electrical signals produced by a user. In this way, the exoskeleton technology may interpret known inputs and learn new inputs, which may lead to a more seamless user experience.

For the purpose of the present disclosure, the term "electrical muscle stimulation" ("EMS") is used to refer to methods in which muscle contraction is elicited by the application of electric impulses. Without limitation, such impulses may be configured to simulate the natural electrical impulses produced by a person as he/she instigates movement of all or a portion of his/her body. More particularly, the electric impulses may be configured to mimic the electrical impulses produced by a person to elicit contraction and/or relaxation of skeletal muscles that are under control of the somatic nervous system, i.e., which are voluntarily controlled.

The phrase "body region of interest," is used herein to refer to portions of the human body to which the exoskeleton technology described herein will be applied. Body regions of interest may include for example one or more joints of the human body, e.g., an ankle, knee, hip, shoulder, elbow, finger, neck, jaw, etc. combinations thereof, and the like, including the skeletal muscles that participate in the actuation of such joints. Alternatively or additionally, a body region of interest may include other regions of the human body, such as the torso, abdomen, buttocks, thighs, calves, etc., combinations thereof, and the like. For the sake of illustration, the present disclosure will focus on the use of the exoskeleton technology described herein as it is applied to the knee of a user. It should be understood that such description is exemplary only, and that the exoskeleton technology described herein may be applied to any body region or combination of body regions of interest.

FIGS. 1A, 1B, and 1C provide front, side, and back views, respectively, of an exemplary exoskeleton system 100 (herein after, "system 100") consistent with the present disclosure. As shown, system 100 includes exoskeleton 102 and controller 103. For the sake of illustration, exoskeleton 102 is depicted as worn by user 101. Exoskeleton 102 includes sensors 104 and muscle actuation interfaces 105.

While the present disclosure envisions embodiments in which sensors 104 and muscle actuation interfaces 105 are independently supported on and/or within the body of a user (e.g., using a tape, an adhesive, an implant, etc.), such configuration is not required. In some embodiments, sensors 104 and/or muscle actuation interfaces 105 are integral to or otherwise supported by a matrix, which is illustrated in the FIGS using shading. When used, the matrix may be configured in any manner that is suitable to support sensors 104 and actuators 105. For example, the matrix may be an article of clothing, a body suit, an elastic band, a bandage, a tape, a brace, orthopedic tights, combinations thereof, and the like. Without limitation, the matrix is preferably in the form of a bodysuit, a brace for a joint (e.g., an ankle brace, knee brace, elbow brace, shoulder brace, wrist brace, finger brace, neck brace, etc.) and/or an abdominal band, any or all of which may be formed from an elastic material. Non-limiting examples of suitable elastic materials that may be used as the matrix include elastic polymers such as ethylene propylene rubber, isoprene rubber, neoprene (polychloroprene) rubber, latex, nitrile rubber, polybutadiene rubber, spandex, silicone rubber, combinations thereof, and the like.

Figure 2:
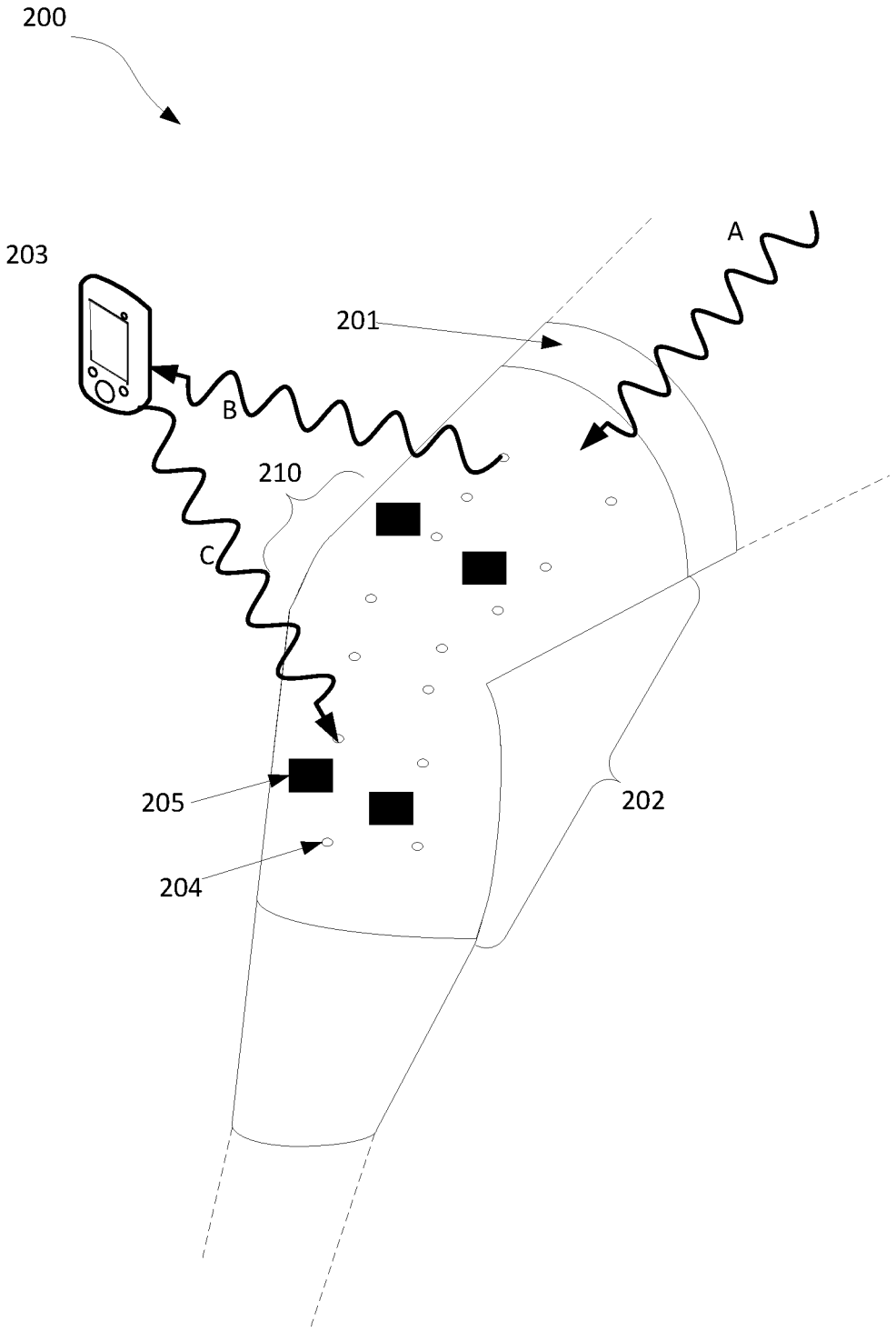
FIG. 2 depicts an exemplary partial exoskeleton consistent with the present disclosure, disposed around a knee of a user.

In any case, the matrix may be configured so as to snugly cover all or a portion of the body of a user. This concept is illustrated by the shading in FIGS. 1A-1C and 2, which illustrate a matrix covering substantially all of the body of user (FIGS. 1A-1C) and a knee of a user, respectively (FIG. 2). Such snug fit may enable the matrix to support sensors 104 and muscle actuation interfaces 105 such that they are in contact with the body of a user. In this way, the matrix may ensure that contact between sensors 104 and actuators 105 is maintained, which may permit such components to perform their respective functions.

Sensors 104 generally function to detect electrical signals and/or other information generated by user 101 as he or she moves or attempts to move a body region of interest. For example, sensors 104 may detect neuronal action potentials (hereinafter, "neuronal signals") produced by user 101. Alternatively or additionally, one or more of sensors 104 may detect user 101's pulse, blood pressure, temperature, combinations thereof, muscle response, and the like. Without limitation, all or a portion of sensors 104 are preferably configured to detect neuronal signals produced by user 101. In particular, sensors 104 may operate to detect neuronal signals produced by user 101 as he/she moves or attempts to move a portion of his/her body by actuating one or more skeletal muscles and/or muscle groups. Such skeletal muscles and/or muscle groups may be located in an arm, leg, abdomen, neck, another portion of user 101's body, or a combination thereof. In some embodiments, such muscles and/or muscle groups may participate in the movement and/or stabilization of a body region of interest, and in particular a joint of the human body.

Sensors 104 may be configured in any suitable manner provided they can detect electrical signals and/or other information produced by a human. In this regard, sensors 104 may be configured to function when in contact with a user's skin, when embedded within a user's skin and/or musculature, and/or when implanted within a user. The nature and configuration of such sensors is well understood in the medical industry, and therefore is not described in detail herein. In some embodiments, one or more of sensors 104 include a skin contact electrode that when placed in contact with a user's skin allows the sensor to detect neuronal signals and/or other information. Without limitation, such sensors may detect neuronal signals from user 101's peripheral/motor neurons, central nervous system, another nerve or body pathway, combinations thereof and the like.

In the embodiment of FIGS. 1A-1C, sensors 104 are depicted as being widely dispersed over user 101's body. It should be understood that such illustration is exemplary only, and that sensors 104 may be located at any suitable location. For example, sensors 104 may be located in the vicinity of one or more of the major joints of a person, such as an ankle, knee, hip, and/or shoulder joint. This concept is illustrated in FIG. 2, which depict an exemplary exoskeleton system that includes a partial exoskeleton as worn about a knee of a user. Accordingly, it should be recognized that the exoskeleton technology described herein is not limited to a full body or near full body system. Indeed, exoskeletons for individual regions of the body (e.g., a knee, an elbow, an abdomen, etc.) are envisioned and encompassed by the present disclosure. Moreover, the exoskeleton technology described herein may be modular. That is, it may be initially applied to a first body region of a user, and subsequently applied to additional body regions when the needs of the user increase.

Likewise, the number of sensors 104 illustrated in FIGS. 1A-1C is exemplary only, and any number of sensors 104 may be used in the exoskeleton technology described herein. In some embodiments, the number of sensors 104 in exoskeleton 102 may vary depending on the extent to which information is to be collected, the body region(s) of interest, affected regions of a user's body, and other factors. For example, the exoskeleton technology described herein may utilize about 1, 2, 3, 4, 5, 10, 15, 20, 50, 100, or even about 1000 sensors. Without limitation, the about 1 to about 20 sensors 104 are used in the exoskeleton technology described herein.

One or more of sensors 104 may be positioned such that it is in proximity to a body region of interest when exoskeleton 102 is worn by a user. Such sensor(s) may be maintained in such position by a matrix, as previously described. For example, sensor(s) 104 may be embedded in a matrix that is in the form of a flexible brace/band such it remains embedded and/or in contact with the skin of a user when exoskeleton 102 is worn. Positioning sensor(s) 104 in proximity to a body region of interest may allow it to detect neuronal signals produced by user 101 to elicit a response from one or more muscles/muscle groups that participate in the movement of such body region. In this way, sensor(s) 104 may detect neuronal signals in a region that is "local" to a body region of interest.

For example, when the body region of interest is a joint such as a knee, sensors 104 may be maintained in proximity to the knee, such as proximal and/or distal to the knee. Such placement may allow sensors 104 to detect neuronal signals produced by user 101 to stimulate one or more muscles/muscle groups that participate in the motion of the knee, e.g., a hamstring muscle, gastrocnemius muscle, gracilis muscle, sartorius muscle, combinations thereof, and the like.

Of course, sensors 104 need not be positioned such that they are local to a body region of interest. In some embodiments, user 101 may be affected by paralysis or another condition that prevents transmission of neuronal signals to the body region of interest (hereinafter, an "affected region"). For example, user 101 may have suffered damage to one or more nerves (e.g., within the spinal cord, in the brachial plexus, in the sacral plexus, etc.) such that transmission of neuronal signals from the brain to the affected region is prevented. In such instances, sensors 104 placed on or local to the affected region may be unable to detect neuronal signals produced by user 101 in an attempt to move such region.

To compensate, one or more of sensors 104 may be positioned such that it can detect neuronal signals produced by user 101 from a body region that is remote from the body region of interest. In some embodiments, one or more sensors 104 may be detect neuronal signals at a point "upstream" of a damaged region of user 101's nervous system, such as at a point along user 101's spinal column, neck, and/or a nervous system pathway that is remote from an affected region. For example, one or more of sensors 104 may be placed so as to detect neuronal signals targeting an affected region from a user's sciatic nerve. Similarly, one or more of sensors 104 may be a cranial sensor that is configured to detect neuronal signals targeting the affected body region when placed on or within user 101's head. In this way, one or more sensors 104 may be positioned to detect neuronal signals produced by user 101 as he/she attempts to move an affected region (body region of interest), even if user 101 is incapable of actually transmitting such signals to such affected region. Data signals including such neuronal signals and/or actuation signals may then be routed to the affected region (e.g., using controller 103, as discussed below), bypassing the portion(s) of user 101's body that may be preventing the transmission of neuronal signals to the affected region using user 101's natural nervous system pathways.

As noted previously, all or a portion of sensors 104 may be configured to detect information other than neuronal signals from user 101. One example of such other information is muscle response information, including but not limited to muscle response information produced by the body region of interest. Non-limiting examples of such muscle response information include muscular action potentials, extent of muscular contraction and/or expansion, range of motion, combinations thereof, and the like. Without limitation, at least one of sensors 104 detects muscular action potentials in a body region of interest. As will be described below, muscle response information may be used by exoskeleton system 100 (and in particular controller 103) to determine the extent to which muscles/muscle groups in a region of interest react to an applied stimulus, i.e., a neuronal signal produced by user 101, an actuation signal produced by controller 103, or a combination thereof.

Sensors 104 may transmit a data signal (not shown in FIGS. 1A-1C) to controller 103. Accordingly, sensors 104 may be in wired and/or wireless communication with controller 103. In the former case (wired communication), sensors 104 may transmit data signals to controller 103 over a wire or other physical connection with controller 103. In the latter case, data signals from sensors 104 may be wirelessly transmitted to controller 103 using one or more predetermined wireless transmission protocols. Without limitation, sensors 104 and controller 103 are preferably in wireless communication with one another.

Regardless of the manner in which sensors 104 and controller 103 communicate, the data signal(s) produced by sensors 104 may include neuronal signal information, muscle response information, or a combination thereof. Such information may correspond to information detected by one or more of sensors 104. For example, information in the data signal may include the waveform and/or intensity of detected neuronal signals, measured muscular action potentials, combinations thereof, and the like. In some embodiments, at least one of sensors 104 produces data signals that include neuronal signal information (e.g., waveform, intensity, combinations thereof, and like), and at least one other sensor 104 produces a data signal that includes muscle response information. In additional embodiments, at least one of sensors 104 produces a data signal that includes both neuronal signal information and muscle response information.

Controller 103 generally functions to receive data signals from sensors 104 and transmit actuation signals (not shown in FIG. 1A-1C) to actuators 105 of exoskeleton 102. Accordingly, controller 103 may be in wired or wireless communication with actuators 105. Without limitation, controller 103 is preferably configured to transmit actuation signals wirelessly to one or more of actuators 105 using one or more predetermined wireless communications protocols.

The actuation signals produced by controller 103 may be configured to elicit and/or enhance the response of one or muscles/muscle groups that participate in the motion and/or stabilization of a body region of interest. For example, the actuation signals may be in the form of electro muscle stimulation (EMS) signals that mimic, copy, or otherwise simulate the natural neuronal signals that are produced when user 101 attempts to move a body region of interest. In some embodiments, the actuation signals produced by controller 103 may repeat (i.e., copy) the neuronal signals detected by sensors 104 when user 101 attempts to move the body region of interest with one or more muscles/muscle groups.

Muscle actuation interfaces 105 generally function to receive actuation signals from controller 103 and apply such actuation signals to one or more muscles/muscle groups in a body region of interest. In particular, muscle actuation interfaces 105 may function to transmit or otherwise communicate an actuation signal from controller 103 to one or more muscles/muscle groups that participate in the movement of the body region of interest, e.g., via actuation of one or more muscles. In this regard, muscle actuation interfaces 105 may be in the form of one or more electrodes that are operable to communicate electrical signals to one or more motor neurons of a muscle/muscle group that participates in the movement and/or stabilization of a body region of interest. Non-limiting examples of such electrodes include skin contact electrodes, embedded electrodes (e.g., needles), implanted electrodes, combinations thereof, and the like, such as those that may be used in electromyography. Without limitation, actuators 105 preferably include one or more skin contact electrodes.

The number of muscle actuation interfaces used in the exoskeleton technology described herein may vary widely. Indeed, the present disclosure envisions exoskeleton systems that utilize 1 or more muscle actuation interfaces, such as about 5, 10, 15, 20, 50, 100, or even 1000 muscle actuation interfaces. The number and placement of muscle actuation interfaces may correspond to the number of muscles/muscle groups that are to be stimulated using actuation signals produced by controller 103. In some embodiments, the exoskeleton technology includes at least one muscle actuation interface for each muscle/muscle group that may be stimulated with an actuation signal from a controller. For example, the exoskeleton technology used herein may include at least one muscle actuation interface that is operable to individually or collectively communicate actuation signals from a controller to one or more muscles/muscle groups that participate in the movement and/or stabilization of a body region of interest.

By way of example, user 101 may wish to articulate a joint (e.g., a knee, elbow, etc.), but may be unable or only weakly able to do so. In such instances, sensors 104 may be positioned to detect neuronal signals produced by user 101 as he/she attempts to articulate the joint. Sensors 104 may transmit a data signal to controller 103 that includes information regarding the detected neuronal signals, e.g., their intensity, waveform, etc. In response to receiving such data signal, controller 103 may transmit an actuation signal that relays, copies or otherwise mimics the detected neuronal signals to muscle actuation interfaces 105 that are in communication with one or more muscles/muscle groups that participate in movement/stabilization of the joint. Muscle actuation interfaces 105 receiving such actuation signals may actively or passively transmit such actuation signals to the muscles/muscle groups with which they are in communication. Such muscles/muscle groups may respond to the applied actuation signals, e.g., by contracting and/or relaxing in a desired manner. Without limitation, actuation signals are preferably generated by controller 103 and applied by muscle actuation interfaces 105 such that the body region of interest moves in a coordinated manner or remains stationary, as desired.

As may be appreciated by the foregoing, application of actuation signals may enable user 101 to move a body region of interest in a desired manner, even if user 101 is incapable of naturally transmitting neuronal signals to such body region. In this way, the exoskeleton technology described herein may act as a bypass to enable communication of neuronal signals (either produced by a user or by controller 103) to one or more muscles/muscle groups that participate in the movement of a body region of interest. In other circumstances, user 101 may be able to transmit neuronal signals to a body region of interest, but one or more muscles/muscle groups that participate in the movement of such body region may only weakly respond to such signals. In those instances, the exoskeleton technology described herein may enhance the responsiveness of such muscles/muscle groups through the application of actuation signals, e.g., by increasing the electrical stimulation of such muscles/muscle groups.

Reference is now made to FIG. 2, which illustrates an exemplary embodiment of the exoskeleton technology described herein as it is applied to a knee of a user. As shown, exoskeleton system 200 includes exoskeleton 202, which in this embodiment is in the form of a flexible knee brace. For the sake of illustration, exoskeleton 202 is depicted as it is worn about a knee 210 of a user 201. Like exoskeleton system 100, exoskeleton system 200 further includes controller 203, sensors 204, and actuators 205. Sensors 204 and actuators 205 are skin contact type sensors/actuators, and are supported within a flexible matrix (illustrated by shading) such that they contact the skin about knee 210.

Sensors 204 may be placed so as to detect neuronal signals (A) generated by user 201 as he/she attempts to flex and/or extend knee 210. This concept is generally illustrated in FIG. 2 by the placement of sensors 204 about the joint of knee 210. Of course, the illustrated number and placement of sensors 204 is exemplary only, and one or more of sensors 204 may be positioned remotely from knee 210, e.g., along user 201's spinal column, head, etc. In any case, sensors 204 may be operable to detect neuronal signals sent to one or more muscles/muscle groups that participate in the movement and/or stabilization of knee 210, e.g., user 101's hamstring, quadriceps, gracilius, etc. combinations thereof, and the like.

Alternatively or in addition to detecting neuronal signals (A), one or more of sensors 204 may be configured to detect muscle response information, including but not limited to muscular action potentials in the muscles/muscle group with which they are associated. Such muscular action potentials may be produced in the muscles/muscle groups of knee 210 in response to neuronal signals generated by user 201, actuation signals produced by controller 203, or a combination thereof. In this way, sensors 104 may detect neuronal signals sent to such muscles/muscle groups, as well as the response of such muscles/muscle groups to such neuronal signals.

In operation, sensors 204 may transmit data signals (B) to controller 103 that include information regarding neuronal signals (A) and/or muscle response information that is detected as user 201 moves or attempts to move knee 210. Data signals (B) may contain information regarding the waveform, intensity, frequency, etc. of detected neuronal signals (A). In addition, data signals (B) may contain muscular action potentials produced by muscles/muscle groups that participate in the movement of knee 210.

In response to receiving data signals (B), controller 203 may transmit one or more actuation signals (C) to muscle actuation interfaces 205. Consistent with the description of FIGS. 1A-1C, actuation signals (C) may be configured to elicit a desired response from one or more muscles/muscle groups that are in communication with one or more of muscle actuation interfaces 205. Thus for example, actuation signals (C) may be in the form of EMS signals that relay, copy, or otherwise mimic the neuronal signals detected by sensors 104. Without limitation, one or more of actuation signals (C) preferably is or includes a copy of the neuronal signals detected by sensors 104.

Controller 203 may be configured to target the transmission of actuation signals (C) to any or all of muscle actuation interfaces 205. In some embodiments, controller 203 may transmit an actuation signal to all of muscle actuation interfaces 205, resulting in the stimulation of all muscles/muscle groups with which actuators 205 are in communication. Alternatively or additionally, controller 203 may transmit an actuation signal to a single muscle actuation interface 205, or a subset of muscle actuation interfaces 205. In the latter case, controller 203 may be configured to process data signals (B) to determine which muscles/muscle groups are targeted by the neuronal signals detected by sensors 204. Once the target muscles/muscle groups are identified, controller 203 may send appropriate actuation signals (C) to muscle actuation interfaces 205 that are in communication with such muscle groups.

For example, sensors 204 may detect multiple different neuronal signals (A), which may be produced when a user moves or attempts to move knee 210. Each detected neuronal signal (A) may target one or more muscles/muscle groups that participate in the movement and/or stabilization of knee 210. For example some of the detected neuronal signals (A) may target a hamstring, whereas others may target a gastrocnemius. As may be appreciated, neuronal signals (A) that target different muscles/muscle groups may have distinct characteristics (wave forms, intensity, etc.), and thus may be distinguished from one another. In such instances, data signals (B) may include information about any or all of the neuronal signals (A) detected by sensors 204.

Controller 204 may process data signal (B) to distinguish the detected neuronal signals (A) from one another. For example, controller 204 may utilize a calibration profile, baseline data, etc. to distinguish the detected neuronal signals from one another. Such calibration and/or baseline data may been previously determined, e.g., from electromyographical measurements performed on the user of exoskeleton 202.

Once it has distinguished the various detected neuronal signals (A) from one another, controller 203 may determine which muscles/muscle groups are targeted by each neuronal signal (A), and which muscle actuation interfaces 205 are in communication with such muscles/muscle groups. In this regard, controller 203 may query a local or remotely stored database that correlates neuronal signal types with particular muscles/muscle groups, as well as actuators 205 that are in communication with such muscles/muscle groups. Using this database, controller 103 may determine which neuronal signals (A) target certain muscles/muscle groups, and/or which muscle actuation interfaces 205 are in communication with such muscles/muscle groups. Controller 203 may then transmit appropriate actuation signals (C) to such muscle actuation interfaces 205.

Alternatively or additionally, sensor(s) 104 may be positioned such that they detect neuronal signals as they arrive at one or more muscles in a body region of interest. For example, a sensor may be placed to detect neuronal signals produced by a user as they arrive at a motor neuron of a muscle in a body region of interest. In such instances, controller 203 may be aware of the muscle(s) that a relevant sensor is positioned to detect, as well as muscle actuation interfaces in communication with such muscle(s). Using this information, controller 203 may correlate the detected signal with an appropriate muscle actuation interface. Such method may be particularly useful when the nervous system pathways to the region of interest are intact, but enhancement of muscle response is desired for therapeutic, strength training, or other reasons.

In still other instances, controller 203 may be programmed to distinguish detected neuronal signals and identify their respective targets using mutual machine-human learning. In such instance, the controller may initially attempt to distinguish neuronal signals and identify pertinent targets using a calibration, a database, etc., as previously described. In the event controller 203 erroneously distinguishes neuronal signals and/or their respective targets, such errors may be corrected by inputs made by user 201 and/or a third party such as a physician.

For example, controller 203 may determine from data signal (B) and the aforementioned database that sensors 204 have detected first and second neuronal signals (A) that target a first muscle and a second muscle, respectively, and that the first and second muscles/muscle groups are in communication with first and second muscle actuation interfaces, respectively. Based on this information, controller 203 may transmit a first actuation signal (C) to the first actuator, and a second actuation signal (C) to the second actuator. The first and second actuation signals (C) may copy or otherwise mimic the neuronal signals (A) directed to the first and second muscles, respectively. In this way, controller 203 may stimulate the first and second muscles using actuation signals (C) that are the same or similar to the neuronal signals (A) naturally produced by user 201 of exoskeleton 202. As such, the first and second muscles may respond to the first and second actuation signals, respectively, in the same or similar manner as they would respond to the natural neuronal signals produced by the user.

In some embodiments, controller 203 may operate in a "repeater mode," wherein it transmits actuation signals (C) to appropriate muscle actuation interfaces 205 each time that it receives a data signal (B) from sensors 204. Such mode may be useful in instances wherein user 201 is unable to naturally transmit neuronal signals to knee 210 or another body region of interest.

For example, knee 210 of user 201 may be affected by paralysis or another condition that prevents natural transmission of neuronal signals from user 201's brain to knee 210. As a result, user 201 may be mentally willing to flex knee 210, but may be unable to do so. In such instance, at least some of sensors 204 may be placed at a region remote from knee 210, e.g., along user 201's spinal column, cranium, etc. such that they may detect neuronal signals (A) targeting muscles/muscle groups that participate in the movement and/or stabilization of knee 210. Sensors 204 may transmit data signal (B) containing information regarding such neuronal signals to controller 203. Controller 203 may process data signal (B) to distinguish the neuronal signals from one another and determine their respective target muscles/muscle groups, as previously described.

Controller 203 in repeater mode may then transmit an actuation signal (C) that is a copy of (i.e., which repeats) neuronal signals (A) to muscle actuation interfaces 205 that are associated with the muscles/muscle groups target by such neuronal signals. In other words, controller 203 may "repeat" in actuation signal(s) (C) the natural neuronal signals (A) produced by user 201 as he/she attempts to move knee 210, and transmit such actuation signal(s) (C) to the muscles/muscle groups targeted by such neuronal signals (A) via one or more of muscle actuation interfaces 205. In this way, controller 203 may (in combination with sensors 204 and muscle actuation interfaces 205), act to bypass a damaged portion of user 201's nervous system, and permit communication of neuronal signals muscles to muscle groups that user 201 may be unable to naturally communicate with due to paralysis or some other condition.

In other embodiments, controller 203 may be configured to operate in an "adaptive mode." In adaptive mode, controller 203 may determine when and if actuation signal(s) (C) should be generated and transmitted to muscle actuation interfaces 205. Such mode may be particularly useful in instances where a user is capable of transmitting neuronal signals to muscles/muscle groups that participate in the movement and/or stabilization of a body region of interest (e.g., knee 210 of FIG. 2.), but such muscles/muscle groups may not respond to such signals to a desired degree. For example, the muscles responsible for moving and/or stabilizing knee 210 may respond to neuronal signals produced by a user of exoskeleton 201, but to an insufficient or undesirable degree and/or with insufficient strength.

When operating in adaptive mode, controller 203 may transmit actuation signals (C) that are configured to enhance the stimulation (and thus, the response) of such muscles, potentially restoring desirable function (e.g., strength, range of motion, etc.) to knee 210 or another body region of interest. In this regard, controller 203 may vary the intensity of muscle stimulation provided by actuation signals (C), e.g., by changing their configuration and/or characteristics. For example, controller 203 may change their waveform, increase/decrease their power/amplitude, combinations thereof, and the like. Actuation signals (C) of relatively low power/amplitude may elicit less response from muscles/muscle groups to which they are applied, as compared to the response elicited by relatively high relative high power/amplitude actuation signals.

Accordingly, controller 203 in adaptive mode may be configured to set the amplitude/power of actuation signals (C) so as to elicit a desired level of response from target muscles/muscle groups. For example, controller 203 may be configured to transmit relatively low power/amplitude actuation signals (C) in instances where user requires/desires less assistance to generate an appropriate muscle response. In contrast, controller 203 may transmit relatively high power/amplitude actuation signals (C) in instances where a user requires/desires relatively more assistance to generate an appropriate muscle response. In some embodiments controller 203 may transmit actuation signals (C) that have substantially the same power/amplitude as the neuronal signals naturally produced by a user of exoskeleton 202.

Controller 203 may in some embodiments adjust the power/amplitude of actuation signals (C) based on muscle response information that is detected by one or more of sensors 204. For example, one or more of sensors 204 may detect muscle actuation potentials that are generated within a target muscle and/or muscle group. In the embodiment of FIG. 2, for example, one or more of sensors 204 may detect the degree to which muscles that participate in the movement and/or stabilization of knee 210 respond to detected neuronal signals (A), and/or actuation signals (C). Based on the detected muscle response information, controller 203 may adjust the power/amplitude of actuation signals upwards or downwards, so as to achieve a desired muscle response level.

Controller 203 may in some embodiments be configured to omit or send actuation signals (C) based on a threshold muscle response level. In such embodiments, controller 203 may omit sending an actuation signal (C) to a muscle actuation interface 205 associated with a muscle/muscle group if neuronal signals (A) produced by a user elicit a muscle response from such muscle/muscle group that meets and/or exceeds the threshold muscle response level. In contrast, controller 203 may send an actuation signal (C) to a muscle actuation interface associated with a muscle/muscle group in instances where neuronal signals (A) elicit a muscle response from such muscle/muscle group that is less than the threshold muscle response level. Sensors 204 may continue to report muscle response information throughout this process, thereby establishing a feedback loop that may be used by controller 203 to make dynamic adjustments to the power/amplitude of actuation signals (C) until a desired muscle response level is achieved. In some instances, controller 203 may be configured to maintain the measured muscle response within a predetermined margin of the threshold muscle response level, e.g., plus or minus about 15, about 10, about 5, or even about 1% of the threshold muscle response level.

The threshold muscle response level may correlate to a pre-determined muscle action potential, pre-determined range of motion, combinations thereof, and the like (collectively, "baseline muscle response information"). Such baseline muscle response information may be obtained and/or determined in any suitable manner. In some embodiments, the baseline muscle response information is set based on measurements of muscle action potential, range of motion, etc., taken on the body region of interest when it was operating in a manner satisfactory to a user (e.g., prior to injury). Alternatively or additionally, baseline muscle response information may be set to a user and/or physician determined value. For example, baseline muscle response information may be set based on muscle responses measured from individuals that are of similar age, ability, and/or health as the user of the exoskeletons described herein.

The baseline muscle response information may be used to set the threshold muscle response level that is used by controller 203 to determine whether to send an actuation signal (C) and, if so, the power/amplitude of such actuation signal. For example, the threshold muscle response level may correspond to a baseline muscle actuation potential. In any case, controller 203 may monitor muscle response information reported by sensors 204, and determine whether it is higher than, lower than, or equal to the baseline muscle action potential. Controller may then determine whether or not to send an actuation signal (C) to a particular muscle/muscle group by comparing the muscle action potentials measured by sensors 204 to the baseline muscle action potential, as generally described above.

As noted previously, controller 203 may monitor the muscle response information in data signals (B) and increase or decrease the power/amplitude of the actuation signal (C) until a desired muscle response is achieved. Alternatively or additionally, the power/amplitude of actuation signals (C) may be adjusted by controller 203 in view of one of more contextual factors, such as but not limited to the location of exoskeleton 202, the user's age, the user's health, the user's pain tolerance, the users measured range of motion, etc. Such information may be pre-loaded on controller 203, e.g., by a user, a physician, or another entity. Such information may be included in a user profile, as described below in connection with FIG. 5.

As explained above, the exoskeleton technology of the present disclosure may utilize a controller and one or more muscle actuation interfaces to stimulate the muscles of a user, so as to elicit a desired muscular response. In this way, the exoskeleton technology may facilitate and/or enhance the movement of a body region of interest by stimulating a user's own musculature in such body region.

Figure 3A:
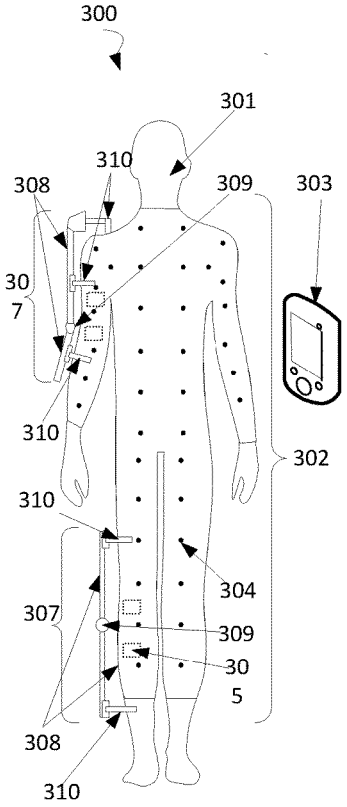
FIGS. 3A, 3B, and 3C depict front, side, and back views, respectively, of another exemplary exoskeleton consistent with the present disclosure, as worn by a user.
Figure 3B:
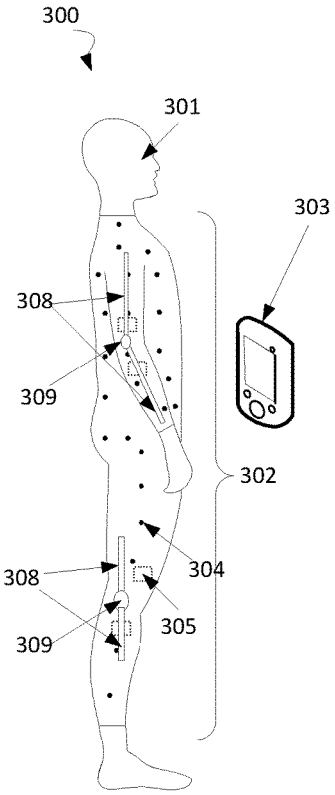
Figure 3C:
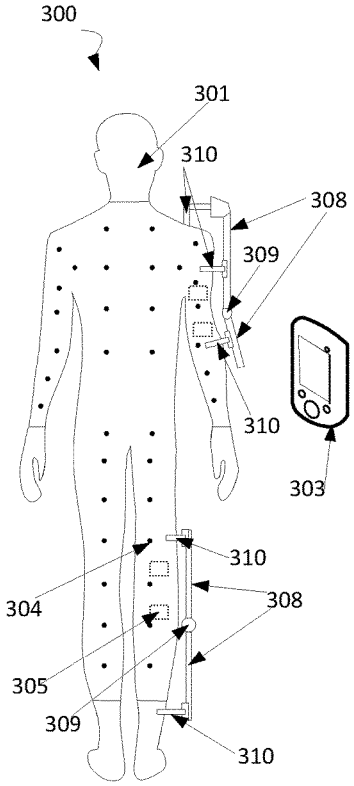

In other embodiments, the exoskeleton technology of the present disclosure may facilitate and/or enhance the movement of a body region via one or more mechanical actuators, either alone or in combination with the stimulation of a user's musculature. In this regard, reference is made to FIGS. 3A-3C, which depict another exemplary exoskeleton system in accordance with the present disclosure. As shown, exoskeleton system 300 includes exoskeleton 302, and controller 303. For the sake of illustration, exoskeleton 302 is depicted in FIGS. 3A-3C as being worn by a user 301. In general, exoskeleton system 302 includes sensors 304, which may be supported in a matrix (illustrated by shading). Such sensors and matrix are configured and function in substantially the same manner as sensors 104, 204 and the matrix described above in connection with FIGS. 1A-1C and 2. Accordingly, the nature and function of such components is not reiterated here. For the sake of clarity, the combination of sensors 304 and the matrix is referred to herein as a "soft exoskeleton."

In addition to the soft exoskeleton, exoskeleton 302 may include one or more "hard" exoskeletal elements, such as hard exoskeletons 307. Hard exoskeletons 307 may each include one or more frame members 308, which may be connected to one or more mechanical actuators 308. In the illustrated embodiment, hard exoskeleton 307 includes two frame members 308, which are connected to respective mechanical actuators 309. Hard exoskeletons 307 may further include connectors 310, which may physically connect hard exoskeleton 307 to a body region of interest of user 301. In the illustrated embodiment, connectors 310 connect frame members 308 to user 301 at regions above and below user 301's elbow and knee. Of course, hard exoskeletons may be applied to any body region of interest, and need not be applied to both an elbow and knee, as illustrated in FIGS. 3A-3C. Moreover, the nature and configuration of the hard exoskeletons described herein is exemplary, and any type and configuration of hard exoskeleton may be used.

Mechanical actuators 309 may be operable to move frame members 308 relative to one another, e.g., to simulate the movement of a body region of interest. In the illustrated embodiment, mechanical actuators 309 may function to move frame members 308 along an arcuate or other path, simulating the flexing and/or extension of user 301's elbow and/or knee. As the frame members traverse along such path, force may be applied through connectors 310 to portions of user 301's arm and/or leg. Accordingly, elements of user 301's arm and/or leg may follow the motion of frame members 308.

The elements of hard exoskeleton 307 may be configured in any suitable manner. For example, hard exoskeleton may be in the form of a robotically actuated joint. Such joint may include two or more frame members 308 connected to at least one mechanical actuator 309, as generally shown in FIGS. 3A-3C. The frame members 308 may be of any suitable geometry. For example, frame members 308 may be rod-like in nature, and may have a circular, hexagonal, or other cross section. Any suitably rigid material may be used to form the frame members, including but not limited to steel, aluminum, iron, titanium, carbon fiber, polymers, combinations thereof, and the like.

Any type of mechanical actuator may be used in the hard exoskeletons of the present disclosure, so long as such actuator is capable of translating input energy/force into linear, rotary, oscillatory, and/or arcuate motion. Non-limiting examples of suitable mechanical actuators include hydraulic actuators, pneumatic actuators, electric actuators, and actuators that convert one form of motion (e.g., rotational/linear/arcuate/etc.) into another form of motion. Without limitation, the mechanical actuators used herein are preferably electric actuators, e.g., actuators that convert electrical energy to mechanical torque, thereby producing linear, rotary, oscillatory, and/or arcuate motion. Such actuators may be configured to produce motion that, in combination with one or more frame members, simulates the motion of one or more joints of a human body.

Like sensors 104, 204, sensors 304 may detect neuronal signals (not shown) and/or other information that is produced as user 301 moves or attempts to move a body region of interest, in this case an arm or leg to which hard exoskeleton 307 is attached. Sensors 304 may then transmit a data signal (not shown) to controller 303. Like the data signals sent by sensors 104, 204, the data signal sent by sensors 304 may include information regarding detected neuronal signals (amplitude, wave form, etc.), as well as other information such as muscle actuation potentials detected in the body region of interest. Controller 303 may process the data signals to identify the body region of interest that is targeted by the detected neuronal signals. Once the body region is determined, controller 303 may send an actuation signal to a mechanical actuator 309 in a hard exoskeleton 307 that is attached to the relevant body portion. For example, if controller 303 determines that neuronal signals detected by sensors 304 target a knee of user 301, it may send an actuation signal to mechanical actuator 309 in the hard exoskeleton attached to the leg of user 301. In response to such actuation signal, the mechanical actuator may cause frame members 308 to move relative to one another, so as to simulate flexion and/or extension of user 301's knee.

Like controllers 103, 203, controller 303 may operate in a "repeater mode." In such mode, controller 303 may send an actuation signal to mechanical actuator(s) 309 each time it determines that a neuronal signal detected by sensors 304 targets a body region of interest. Thus for example, controller 303 in FIG. 3 may send an actuation signal to a mechanical actuator 309 in user 301's knee, each time it determines that a neuronal signal detected by sensors 304 targets such knee.

Likewise, controller 303 may operate in an "adaptive mode." In this mode, controller 303 may act in much the same manner as controllers 203 and 103 operating in an adaptive mode, as described above. However, instead of adjusting the power/intensity of actuation signals transmitted to user 301's muscles, controller 303 may adjust the power/intensity or other characteristics of actuation signals transmitted to mechanical actuator(s) 309. Such changes may alter the manner in which mechanical actuator(s) 309 respond. In this way, controller 303 may dynamically adjust the degree to which mechanical actuator(s) 309 respond.

For example, user 301 may be capable of transmitting neuronal signals to muscles/muscle groups that participate in the movement and/or stabilization of a body region of interest (e.g., a elbow or knee as shown in FIG. 3), but such muscles/muscle groups may not respond to such signals to a desired degree. For example, the muscles responsible for moving and/or stabilizing user 301's knee may respond to neuronal signals produced by user 301, but to an insufficient or undesirable degree and/or with insufficient strength.

Figure 4:
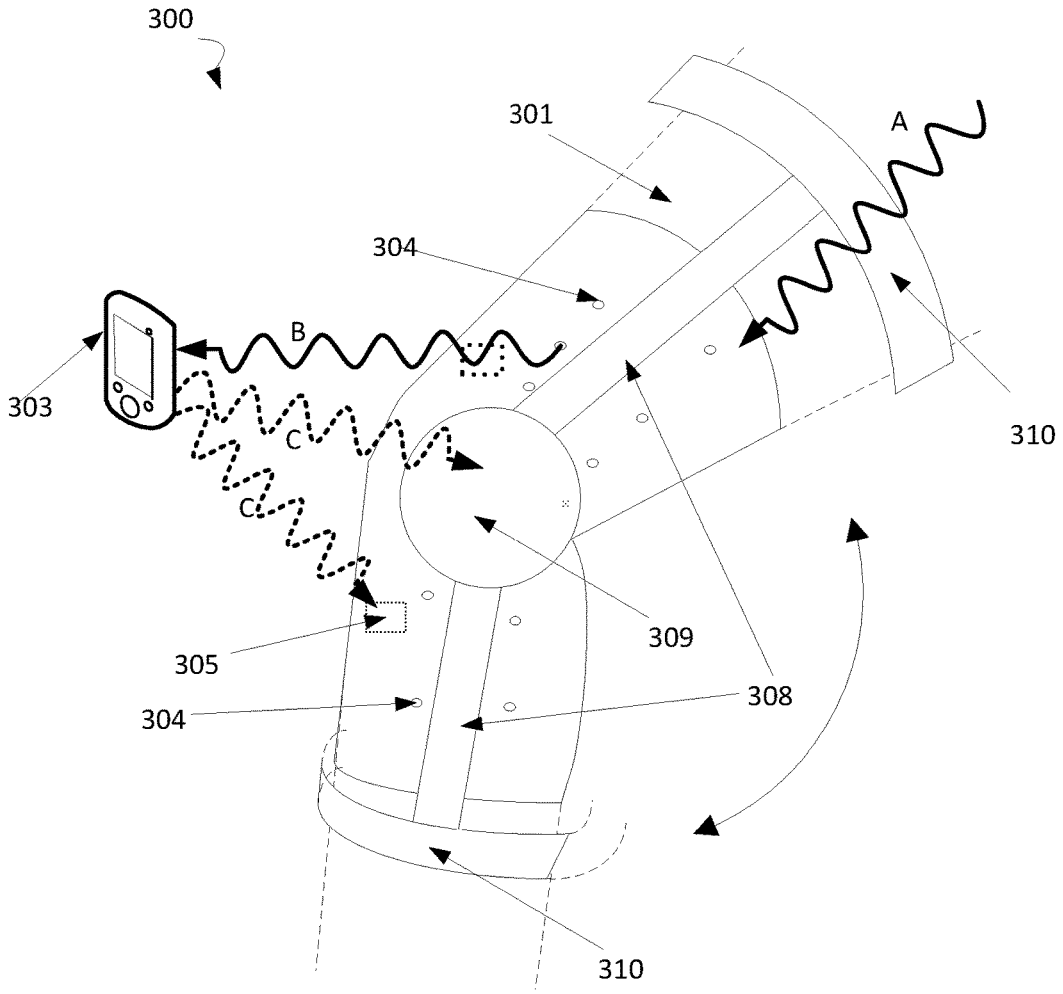
FIG. 4 depicts another exemplary partial exoskeleton consistent with the present disclosure, disposed about a knee of a user.

To illustrate this concept, reference is made to FIG. 4, which depicts an embodiment wherein exoskeleton system 300 is applied to a knee 410 of user 301. As shown, exoskeleton system 300 includes a soft exoskeleton (not labeled) composed of a matrix (illustrated by shading) that supports one or more sensors 304 in proximity to knee 410. In this embodiment, sensors 304 may be skin contact sensors. At least one of sensors 304 is operative to detect neuronal signals (A) generated by user 301 as he/she moves or attempts to move knee 410. In addition, at least one of sensors 304 may detect other information produced as user 301 moves or attempts to move knee 410, such as muscle response information (e.g., muscular action potentials) generated by muscles that participate in the movement of knee 410 in response to neuronal signals (A).

When operating in adaptive mode, controller 303 may receive data signals (B) from sensors 304. As noted above, data signals (B) may include information regarding neuronal signals detected by sensors 304, such as muscle response information. Controller 303 may analyze data signals (B) and determine which neuronal signals target muscles/muscle groups that participate in the movement and/or stabilization of knee 410. In addition, controller 303 may analyze data signals (B) to determine the degree to which such muscles/muscle groups respond to such the detected neuronal signals. If controller 303 determines that the response of such muscles/muscle groups is adequate, it may omit sending an actuation signal to mechanical actuator 309. Alternatively, controller 303 may determine that the response of such muscles is inadequate or otherwise undesirable. In such instances, controller 303 may send an actuation signal (C) to mechanical actuation 309. Upon receiving actuation signal (C), actuator may cause frame members 308 to move relative to one another, preferably along or substantially along the natural path of user 301's tibia, knee, and femur during the natural flexion and contraction of knee 410. In this way, the exoskeleton technology described herein may use one or more mechanical actuators to facilitate, enhance, or supplant the natural movement of a body region of interest.

Like controllers 103 and 203, controller 303 may be configured to set the amplitude/power (or other characteristic) of actuation signals (C) so as to elicit a desired response from a mechanical actuator 309. For example, controller 303 may adjust actuation signals (C) such that they cause a mechanical actuator 309 to move frame members 308 to a particular degree, at a desired rate, and/or with a desired amount of force. Accordingly, controller 303 may adjust actuation signals (C) such that they cause mechanical actuator to provide a desired amount of assistance to user 301 as he/or she moves or attempts to move knee 410.

Also like controllers 103 and 203, controller 303 may in some embodiments adjust actuation signals (C) based on muscle response information that is detected by one or more of sensors 304. For example, one or more of sensors 304 may detect muscle actuation potentials that are generated within a target muscle and/or muscle group. In the embodiment of FIG. 3, for example, one or more of sensors 304 may detect the degree to which muscles that participate in the movement and/or stabilization of knee 410 respond to detected neuronal signals (A), and/or actuation signals (C). Based on the detected muscle response information, controller 303 may adjust actuation signals (C) such that so as to control the degree, rate, and force of movement produced by mechanical actuator 309.

Further like controllers 103 and 203, controller 303 may in some embodiments be configured to omit or send actuation signals (C) based on a threshold muscle response level. In such embodiments, controller 303 may omit sending an actuation signal (C) to mechanical actuator 309 associated with a body region of interest if neuronal signals (A) produced by a user elicit a response from muscles/muscle groups in such body region that meet and/or exceed the threshold muscle response level. In contrast, controller 303 may send an actuation signal (C) to a mechanical actuator 309 associated with a body region of interest in instances where neuronal signals (A) elicit a muscle response from muscles/muscle groups that is less than the threshold muscle response level. Sensors 304 may continue to report muscle response information throughout this process, thereby establishing a feedback loop that may be used by controller 303 to make dynamic adjustments to the power/amplitude of actuation signals (C) until the threshold muscle response is reached or the body region is moved in the desired manner. The threshold muscle response information may be set by baseline muscle response information and/or contextual information, as described previously.

The foregoing description has focused on exemplary embodiments wherein the exoskeleton technology described herein enable or assist movement of a body region of interest using electro muscle stimulation (EMS) applied through muscular actuation interfaces of a soft skeleton or the mechanical movement of a hard exoskeleton. While such embodiments are useful, the present disclosure is not limited to exoskeleton technology that utilizes EMS or mechanical movement of a hard exoskeleton. Indeed, the present disclosure envisions exoskeleton technology that utilizes a combination of EMS and mechanical movement of a hard exoskeleton to facilitate, enhance, and/or supplant the movement of a body region of interest.

To illustrate this concept, reference is again made to FIGS. 3A-3C and 4. As described previously, such FIGS. depict an exoskeleton system 300 as including a soft exoskeleton (including a matrix and sensors 304) and a hard exoskeleton (including frame members 308, mechanical actuator 309, and connectors 311). In addition to such components, exoskeleton system may optionally include muscle actuation interfaces 305. When used, actuators 305 may be operable to apply one or more actuation signals (C) produced by controller 303 so as to stimulate muscles that participate in the movement and/or stabilization of a body region of interest, e.g., using EMS. In other words, muscle actuation interfaces 305 may function in substantially the same manner as muscle actuation interfaces 105 and 205, as discussed above in connection with FIGS. 1A-1C and 2.

As may be appreciated, use of a combination of muscle actuation interfaces 305 and mechanical actuators 309 may open up numerous options for facilitating, enhancing, and/or supplanting the natural movement of a body region of interest. In this regard, controller 303 may operate in a repeater mode or an adaptive mode, as previously described. In repeater mode, controller send actuation signals (C) to both muscle actuation interfaces 305 and mechanical actuators 309 each time that is determines that a neuronal signal (A) detected by sensors 304 targets muscles/muscle groups in a body region of interest, e.g., knee 410. As described previously, actuation signals (C) sent to muscle actuation interfaces 305 may be in the form of EMS signals that stimulate one or more muscles that participate in the movement of a body region of interest, such as knee 410 in FIG. 4. Such EMS signals may be varied in a power/amplitude so as to elicit a desired level of muscle response. Similarly, actuation signals (C) sent to mechanical actuators 309 may be configured to produce a desired movement of frame members 308. In this way, exoskeleton system 300 may facilitate, enhance, or supplant the natural movement of the body region of interest with a combination of EMS (applied through muscle actuation interfaces 305) and mechanical motion of a hard exoskeleton (e.g., via mechanical actuator (s) 309).

When configured in adaptive mode, controller 303 may determine whether to send actuation signals (C) to one or more of muscle actuation interfaces 305 and mechanical actuators 309. If controller 303 determines that actuation signals may be sent, it may further determine to which muscle actuation interfaces and which mechanical actuators such signals are transmitted. For example, controller 303 may send actuation signals to only muscle actuation interfaces 305 or mechanical actuators 309, even though both may be available. In other embodiments, controller 303 may send actuation signals to both muscle actuation interfaces 305 and mechanical actuators 309. In either instance, controller may adjust the control signals sent to muscle actuation interfaces 305 and mechanical actuators 309 so as to produce a desired motion of the body area of interest.

Controller 303 may determine which of muscle actuation interfaces 305 and mechanical actuators 309 to send actuation signals (C) based on individual needs of a user, and/or other information detected by sensors 304. For example, controller 303 may initially attempt to elicit a desired motion of a body region of interest using EMS, i.e., by sending actuation signals to muscle actuation interfaces 305. Such actuation signals may elicit a response from one or more muscles that participate in the motion of the body region of interest. Controller 303 may monitor the effectiveness of the actuation signals by monitoring muscle response information contained in data signals received from sensors 304. If the actuation signals sent to muscle actuation interfaces 305 elicit a suitable muscle response, controller may continue to utilize EMS/muscle actuation interfaces 305, and may not send actuation signals to mechanical actuators 309. If EMS stimulation through muscle actuation interfaces 305 does not produce an adequate response, controller 303 may supplement or replace such stimulation with the mechanical motion of a hard exoskeleton, e.g. by sending actuation signals to a mechanical actuator 309.

Controller 303 may therefore dynamically adjust the type of assistance provided to a body region of interest, e.g., by directing actuation signals to one or both of muscle actuation interfaces 305 and mechanical actuators 309. Controller 303 may also dynamically adjust the degree of assistance that is provided by EMS (through muscle actuation interfaces 305) and mechanical motion (through mechanical actuator 309) by adjusting the amplitude, power, or other characteristics of the actuation signals sent to such actuators.

Figure 5:
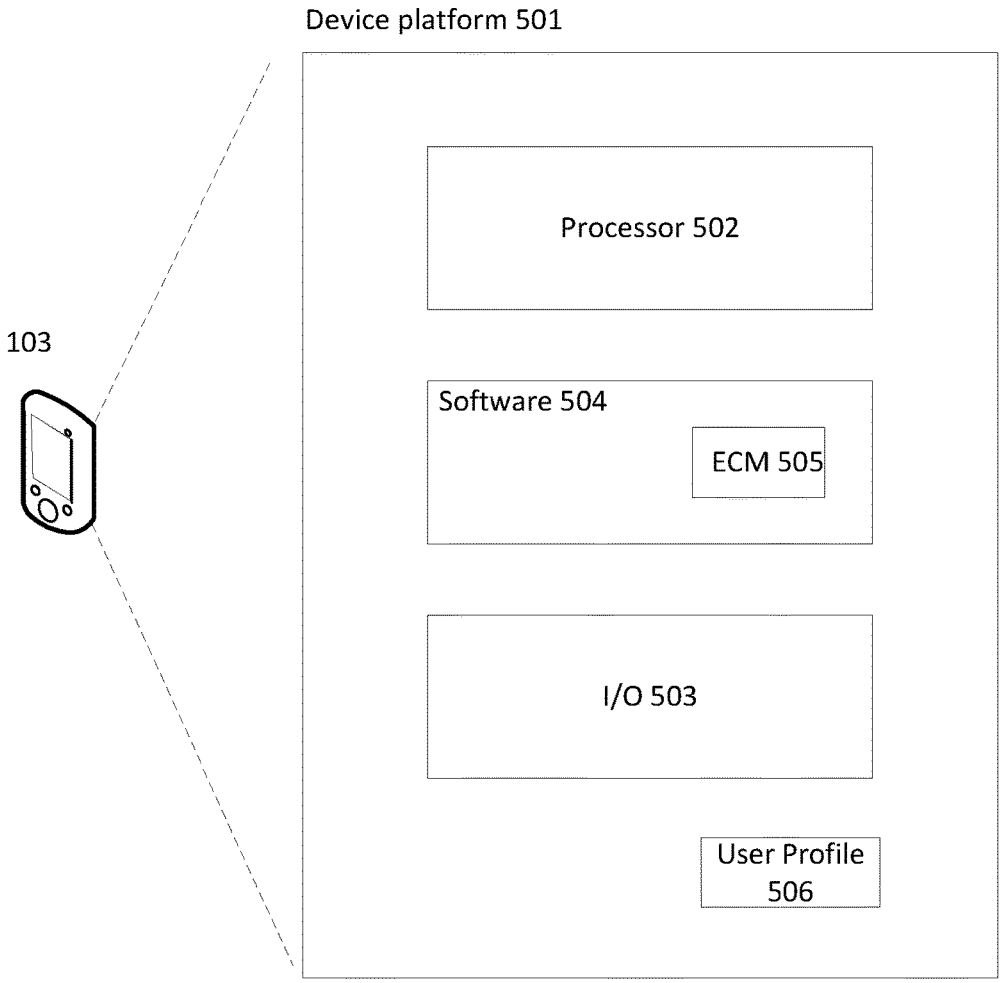
FIG. 5 is a block diagram of an exemplary exoskeleton control system consistent with the present disclosure.

Reference is now made to FIG. 5, which depicts and exemplary system architecture of a controller consistent with the present disclosure. As shown, controller 103 includes device platform 501. For the sake of illustration only, controller 503 is depicted as a mobile device and thus, platform 501 may be a mobile device platform. Non-limiting examples of suitable mobile device platforms include cell phone platforms, smart phone platforms, tablet personal computer platforms, laptop computer platforms, netbook platforms, and combinations thereof. While such platforms may be preferred, it should be understood that they are exemplary only and that device platform may be any suitable platform, including but not limited to a desktop computer platform.

Device platform 501 includes at least one host processor 502, which may be any suitable type of processor. For example, host processor 502 may be a single or muti-core processor, a general purpose processor, an application specific integrated circuit, combinations thereof, and the like. Without limitation, host processor 502 is preferably one or more processors offered for sale by INTEL™ Corporation.

Device platform further includes input/output (I/O) component 502. I/O component 502 may be any type of component that is that is capable of receiving data signals and sending actuation signals to/from controller 103. For example, I/O component 502 may be an antenna, a transmitter, a receiver, a transceiver, a transponder, a network interface device (e.g., a network interface card), combinations thereof, and the like. I/O component 502 may be capable sending and/or receiving data/actuation signals using one or more wired or wireless communications protocols. In some embodiments, I/O component 502 may be operable to send/receive such signals using one or more wired and/or wireless communications technologies, such as BLUETOOTH™, near field communication (NFC), a wireless network, a cellular phone network, combinations thereof, and the like.

Host processor 502 may be configured to execute software 504. Software 504 may include, for example, one or more operating systems and applications both not shown). In the illustrated embodiment, software 504 includes exoskeleton control module (ECM) 505.

Generally, ECM 505 is in the form of computer readable instructions that may be stored within a memory (not shown) of controller 103. For example, ECM 505 may be stored on memory that is local to host processor 502, and/or in another memory within controller 103. Such memory may include one or more of the following types of memory: semiconductor firmware memory, programmable memory, non-volatile memory, read only memory, electrically programmable memory, random access memory, flash memory (which may include, for example, NAND or NOR type memory structures), magnetic disk memory, and/or optical disk memory. Additionally or alternatively, such memory may include other and/or later-developed types of computer-readable memory.

It should therefore be understood ECM 505 may be in the form of instructions stored in a computer readable medium and when executed may cause controller 103 to perform controller operations consistent with the present disclosure. For example, ECM 505 when executed may cause controller 103 to monitor for data signals received from sensors, analyze such data signals, and transmit actuation signals to appropriate muscle actuation interfaces and/or mechanical actuators. Such operations are consistent with the functions of controllers 103, 203, and 303 discussed above, and so are not reiterated here.

Device platform 501 may further include user profile 506. Without limitation, user profile 506 may be a database stored in a memory of device platform 501, and may include one or more contextual factors that may be applied to govern the operation of controller 103. For example, user profile 506 may include information regarding the location of the exoskeleton in question, the mode of operation, the user's age, user's health, user's pain tolerance, baseline range of motion, baseline muscle response, location etc. When executed, ECM 505 may cause processor 502 to adjust the power/amplitude and/or other characteristics of one or more actuation signals in view of information stored in user profile 506. For example, user profile 506 may indicate that the baseline muscle response of a user is less than an average baseline muscle response for a population of individuals that are similar to the user. In such instances, ECM 505 may cause processor 503 to adjust the power/amplitude of actuation signals generated by controller 103 either upward or downward, so as to compensate or account for such disparity.

In other embodiments, ECM 505 when executed may cause processor 502 to apply location information in user profile 506 to make appropriate modifications to actuation signals produced by controller 103. For example, user profile 506 may indicate that user 502 is in a location where additional assistance may be desirable, e.g., in a roadway, a crowd, etc. In such instances, ECM 505 may when executed may cause processor 502 to increase the power/amplitude of actuation signals produced by 103, so as to elicit a larger response from the user's muscles (e.g., via stimulation through a muscle actuation interface) and/or a mechanical motion generated with a mechanical actuator.

Figure 6:
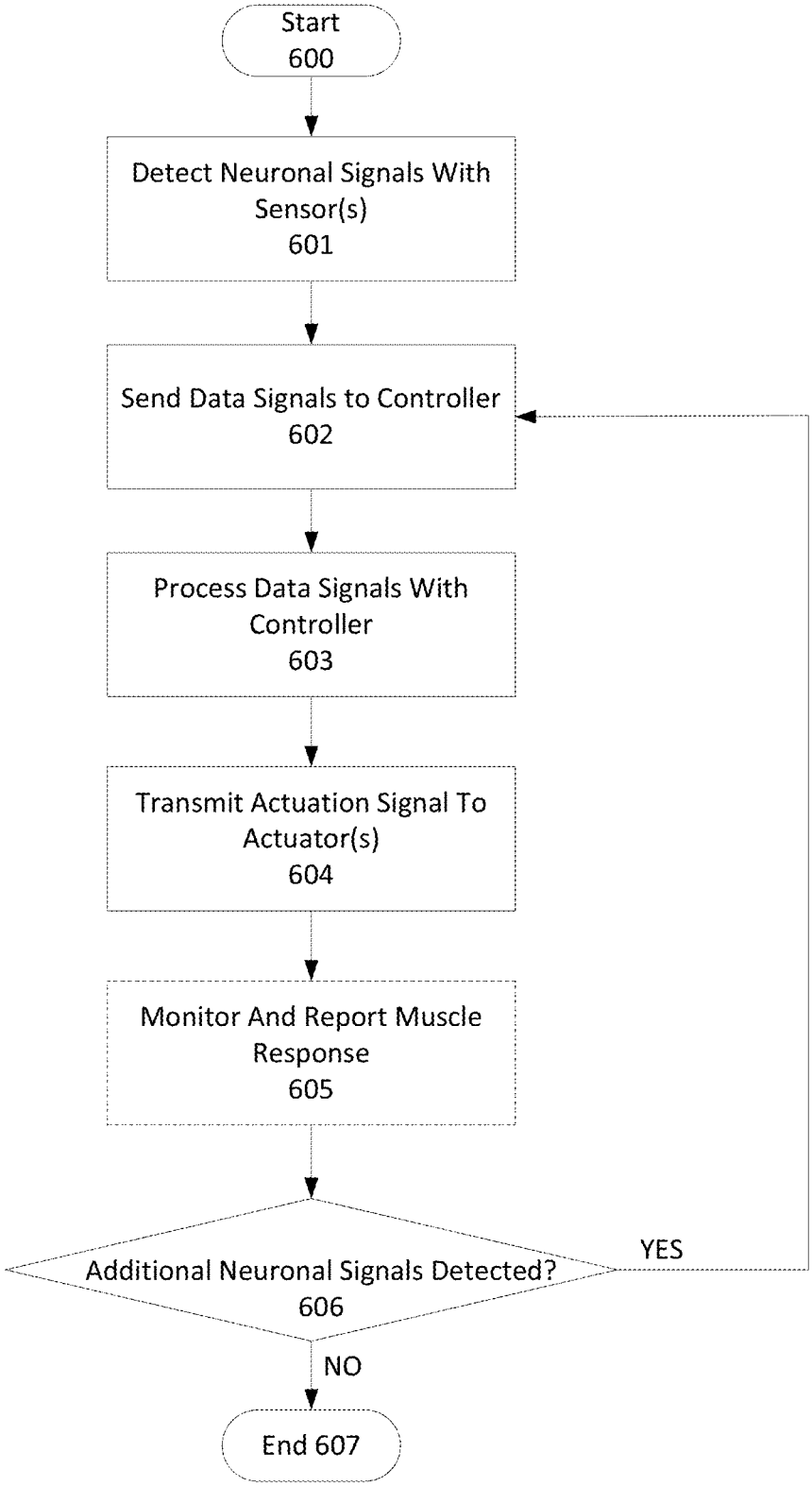
FIG. 6 is a flow chart of an exemplary method consistent with the present disclosure.

Another aspect of the present disclosure relates to methods of controlling exoskeletons and exoskeleton technology. In this regard, reference is made to FIG. 6, which depicts an exemplary controller method consistent with the present disclosure, in which a controller is operated in a repeater mode. As shown, the controller method begins at block 600. At block 601, neuronal signals targeting a body region of interest are detected, e.g., using one or more sensors as previously described. At block 602, data signal(s) containing information about the detected neuronal signals is sent to a controller. At block 603, the controller processes the data signal(s). Via such processing, the controller may determine distinguish the detected neuronal signals from one another, and/or determine which muscles/muscle groups such signals target.

The method may then proceed to block 604, wherein the controller transmits an actuation signal to a muscle actuation interface and/or a mechanical actuator. As previously described, the controller may send such actuation signals to all of a subset of muscle actuation interfaces and mechanical actuators with which it is in communication. Without limitation, the controller preferably sends actuation signals to muscle actuation interfaces that are in communication with muscles/muscle groups targeted by a detected neuronal signal. In any case, the actuation signals may include a repeat (i.e., a copy) of the neuronal signals detected by one or more sensors in block 602. In instances where the controller targets actuation signals to specific muscle actuation interfaces and/or mechanical actuators, the controller may limit neuronal signal information in such actuation signal to information that is relevant to the muscle/muscle group and/or body region with which a muscle actuation interface or mechanical actuator is in communication.

For example, a sensor may detect first and second neuronal signals that target a hamstring and a gracillius muscle, respectively. In this instance, the controller may transmit actuation signals to first and second muscle actuation interfaces that are in communication with the targeted hamstring and gracillius. Such actuation signals may include a copy of one or both of the first and second neuronal signals. For example, the actuation signal sent by the controller to the first muscle actuation interface may include a copy of the first neuronal signal, and the actuation signal sent to the second muscle actuation interface may include a copy of the second neuronal signal.

The method may then proceed to optional block 605, wherein the response of one or more muscles/muscle groups may be monitored (e.g., by one or more sensors) and reported to the controller. Monitoring of such muscle response may in some embodiments be limited to muscles/muscle groups that are in communication with one or more muscle actuation interfaces and/or mechanical actuators that receive an actuation signal. Alternatively or additionally, muscle response may be monitored and reported for each muscle/muscle group that is in communication with an actuator. Such monitoring and reporting may be performed continuously, intermittently, and/or at a specified time period or interval. In some instances, muscle response may be monitored shortly after the transmission of an actuation signal to an actuator. In this way, the exoskeleton technology described herein may monitor the effectiveness of applied actuation signals in eliciting a desired muscle/mechanical response.

In any case, the method may proceed to block 606, wherein a determination is made as to whether additional neuronal signals are detected. If so, the method may loop back to block 602 and repeats. If not, the method may proceed to block 607 and end.

Figure 7:
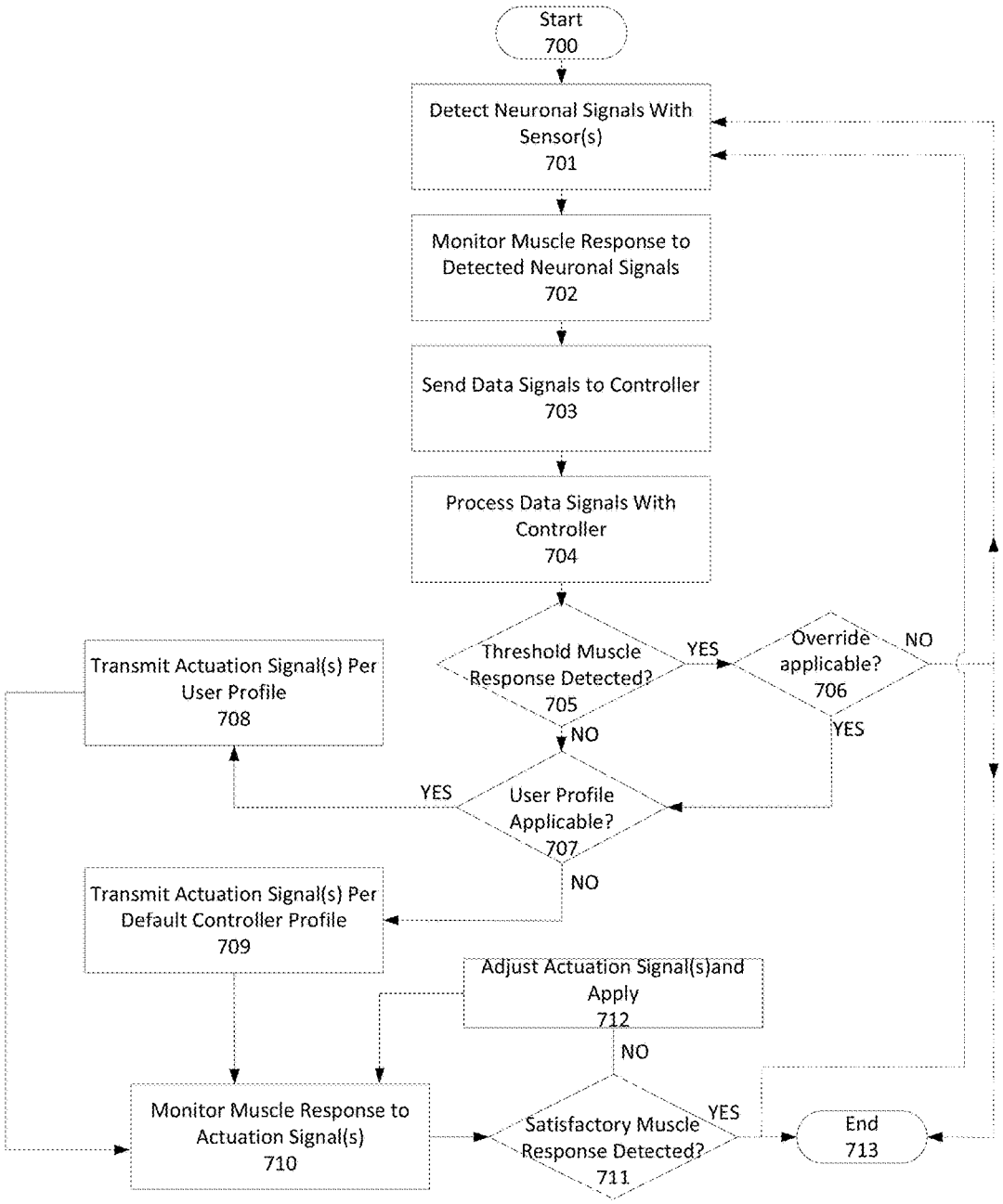
FIG. 7 is a flow chart of an exemplary controller method consistent with the present disclosure.

FIG. 7 depicts another exemplary controller method in accordance with the present disclosure, wherein a controller is operated in an adaptive mode. As shown, the method begins at block 700. At block 701, neuronal signals produced by a user of the exoskeleton technology described herein are detected with one or more sensors. At block 702, one or more sensors monitor the muscle response of the user to the detected neuronal signals. At block 703, one or more sensors may send a data signal to an exoskeleton controller. Such data signal may include neuronal signal information and muscle response information, as previously described.

At block 704, a controller processes data signals received from one or more sensors, e.g., to distinguish various detected neuronal signals from one another, determine their respective targets, and/or associate them with particular measured muscle response information. At this point, the method may proceed to block 705, wherein a determination is made as to whether the muscle response elicited by the detected neuronal signals exceeds a threshold value. If the muscle response exceeds the threshold value, the method may proceed to block 706, wherein a determination is made as to whether an override is applicable. Such an override may be useful, for example, when the threshold muscle response has been determined to be insufficient, and/or if the exoskeleton technology described herein is being used to enhance motion/mobility regardless of the capabilities of the user. Regardless, if no override applies, the method may loop back to block 701 and repeat, or it may proceed to block 713 and end.

If a threshold muscle response is not detected or if an override applies, the method may proceed to block 707, wherein a determination is made as to whether a user profile is available and, if so, whether one or more factors in it should be applied. If a user profile is applicable and is to be applied, the method may proceed to block 708, wherein the controller transmits one or more actuation signals to one or more muscle actuation interfaces and/or mechanical actuators, taking into account the conditions specified in the user profile. If no user profile is available, or if one is available but will not be applied, the method may proceed to block 709, wherein the controller transmits one or more actuation signals to one or more muscle actuation interfaces and/or mechanical actuator, based on a default controller profile. Such default control profile in some embodiments may be set so as to compensate for deficiencies between the detected muscle response and the threshold muscle response.

Regardless of whether the controller transmits actuation signals based on a user profile or a default controller profile, the method may then proceed to block 710, wherein the controller monitors the response of muscles receiving the actuation signal via one or more sensors. The method may then proceed to block 711, wherein a determination is made as to whether a satisfactory muscle response to the actuation signal is detected. Such satisfactory muscle response may be equivalent to the threshold muscle response (e.g., utilized in block 705), or another muscle response level (as may be set in a user profile). If a satisfactory muscle response is not detected, the method may proceed to block 712, wherein the controller adjusts one or more characteristics of the actuation signal, such as its amplitude, power, etc., and transmits the adjusted actuation signal to one or more actuators. The method may then loop back to blocks 710 and 711, wherein muscle response to the adjusted actuation signal(s) is monitored and a determination is made as to whether the adjusted signal produced a satisfactory muscle response. Once a satisfactory muscle response is detected, the method may loop back to block 701, or it may proceed to block 713 and end.

Accordingly, one example of the present disclosure relates to an exoskeleton system. The exoskeleton system includes a sensor, a muscle actuation interface, and a controller. The sensor is operable to detect a first neuronal action potential produced by a person to elicit a first response from a first muscle in a body region of the person, and to transmit a data signal representative of the first neuronal action potential to the controller. The controller is operable to receive and process the data signal and to transmit a first actuation signal to the muscle actuation interface. Finally, the muscle actuation interface is operable to apply said first actuation signal to the first muscle, wherein the first actuation signal is configured to elicit a second response from the first muscle, the second response being proportional to the first response.

Another exemplary exoskeleton system includes any or all of the foregoing components, wherein the first actuation signal includes a copy of the first neuronal action potential.

Another exemplary exoskeleton system includes any or all of the foregoing components, wherein the sensor is further operable to detect a second neuronal action potential produced by a user to elicit a third response from a second muscle in the body region, and to transmit a data signal representative of the first and second neuronal action potentials to the controller.

Another exemplary exoskeleton system includes any or all of the foregoing components, wherein the controller is operable to: determine that the first and second neuronal action potentials target the first and second muscles, respectively; and transmit the first actuation signal and a second actuation signal to the muscle actuation interface, such that the first actuation signal is applied to the first muscle and is configured to elicit the second response from the first muscle, and the second actuation signal is applied to the second muscle and is configured to elicit a fourth response from the second muscle, wherein the second and fourth responses are proportional to the first and third responses, respectively.

Another exemplary exoskeleton system includes any or all of the foregoing components, wherein: the sensor is operable to detect the first response and include first response information indicative of the first response in the data signal; the controller is operable to compare the first response information to a threshold value; when the first response information is less than the threshold value, the controller transmits the first actuation signal to the muscle actuation interface; and when the first response information is greater than or equal to the threshold value, the does not send the first actuation signal.

Another exemplary exoskeleton system includes any or all of the foregoing components, wherein the first threshold value is a threshold muscle response level, and the first response information is a muscle response level of the first muscle in response to the first neuronal signal.

Another exemplary exoskeleton system includes any or all of the foregoing components, wherein the second response enhances the first response by an amount less than, equal to, or greater than a difference between the first response information and the first threshold value.

Another exemplary exoskeleton system includes any or all of the foregoing components, the sensor is operable to detect the first and third response and include first and third response information in the data signal, the first and third response information being indicative of the first and third responses, respectively; the controller is operable to compare the first and third responses to first and second threshold values, respectively; the controller is operable to transmit the first actuation signal when the first response information is less than the first threshold value; the controller is operable to transmit the second actuation signal when the third response information is less than the second threshold value; when the first response information is greater than or equal to the first threshold value, the controller does not send the first actuation signal; and when the third response information is greater than or equal to the second threshold value, the controller does not send the second actuation signal.

Another exemplary exoskeleton system includes any or all of the foregoing components, wherein: the first muscle is located in a limb of the person; the sensor is operable to detect the neuronal action potentials from a spinal column of the person; and the muscle actuation interface is operable to apply the first actuation signal to the first muscle.

Another exemplary exoskeleton system includes any or all of the foregoing components, wherein when the first actuation response information differs from the threshold value by more than a predetermined amount, the controller is configured to adjust at least one characteristic of the first actuation signal until the first actuation response information differs from the threshold value by less than the predetermined amount.

Another exemplary exoskeleton system includes any or all of the foregoing components, wherein: when the first actuation response information differs from the first threshold value by more than a first predetermined amount, the controller is configured to adjust at least one characteristic of the first actuation signal until the first actuation response information differs from the first threshold value by less than the first predetermined amount; and when the second actuation response information differs from the second threshold value by more than a second predetermined amount, the controller is configured to adjust at least one characteristic of the second actuation signal until the second actuation response information differs from the second threshold value by less than the first predetermined amount.

Another example of the present disclosure relates to an exoskeleton system that includes a sensor, a mechanical actuator, and a controller. The sensor is operable to detect a neuronal action potential produced by a person to elicit a muscle response in a body region of the person, and to transmit a data signal representative of the neuronal action potential to the controller. The controller is operable to receive and process the data signal and to transmit an actuation signal to the mechanical actuator. Finally, the mechanical actuator is coupled to at least one frame member comprising at least one connector, and is operable in response to the actuation signal to emulate with the at least one frame member at least a portion of the muscle response.

Another exemplary exoskeleton system includes any or all of the foregoing components, wherein the body region is a joint of the person, the muscle response comprises at least one of flexion of the joint, extension the joint, rotation of the joint, and a combination thereof, and the mechanical actuator is operable in response to the actuation signal to emulate with the at least one frame member at least a portion of the flexion, the extension, the rotation, or the combination thereof.

Another exemplary exoskeleton system includes any or all of the foregoing components, wherein the body region is a knee, and the mechanical actuator is operable in response to the actuation signal to emulate with the at least one frame member at least one of flexion, extension, and rotation of the knee.

Another exemplary exoskeleton system includes any or all of the foregoing components, wherein the sensor is operable to detect response information indicative of a degree to which the muscles in the body region respond to the neuronal action potential, and to include the response information in the data signal; the controller is operable to compare the response information to a threshold value; when the response information is less than the threshold value, the controller is configured to transmit the first actuation signal to the mechanical actuator; and when the response information is greater than or equal to the threshold value, the controller is configured to not send the first actuation signal.

Another exemplary exoskeleton system includes any or all of the foregoing components, wherein the response information is a muscle response level, a muscle action potential, a range of motion, a force, or a combination thereof.

Another example of the present disclosure is an exoskeleton that includes a sensor, a controller, a muscle actuation interface, and a mechanical actuator. The sensor is operable to detect a neuronal action potential produced by a person to elicit a first muscular response in a body region of the person, and to transmit a data signal representative of the neuronal action potential to the controller. The controller is operable to receive the data signal and to transmit at least one of a muscle actuation signal to the muscle actuation interface and a mechanical actuation signal to the mechanical actuator. The muscle actuation interface is operable to electrically stimulate the at least one muscle with the muscle actuation signal, the muscle actuation signal configured to elicit a second muscular response of the body region that is proportional to the first muscular response. Finally, the mechanical actuator is coupled to at least one frame member, and is operable in response to the mechanical actuation signal to emulate at least a portion of the first muscle response with the at least one frame member.

Another exemplary exoskeleton system includes any or all of the foregoing components, wherein the controller is configured to, in response to receiving the data signal, transmit the muscle actuation signal and the mechanical actuation signal to the muscle actuation interface and the mechanical actuator, respectively.

Another exemplary exoskeleton system includes any or all of the foregoing components, wherein: the data signal further comprises response information indicative of a degree to which muscles in the body region respond to the neuronal action potential; and the controller is configured compare the response information to a threshold value, and to adjust at least one of the power and amplitude of at least one of the muscle actuation signal and the mechanical actuation signal if the response information differs from the threshold value by greater than or equal to a predetermined amount.

Another exemplary exoskeleton system includes any or all of the foregoing components, wherein the threshold value is a threshold muscle action potential value, and the response information comprises a muscle action potential detected by the sensor from the muscles in the body region.

Another exemplary exoskeleton system includes any or all of the foregoing components, wherein the predetermined value is greater than or equal to about +/−5% of the threshold muscle action potential value.

Another exemplary exoskeleton system includes any or all of the foregoing components, wherein the controller is configured to transmit the mechanical actuation signals to the mechanical actuator when the muscle action potential detected by the sensor is less than the threshold muscle action potential value by greater than or equal to about 25%.

Another exemplary exoskeleton system includes any or all of the foregoing components, wherein: the sensor monitors the response information and reports the response information to the controller in the data signal; and the controller is configured to dynamically adjust at least one of a power and amplitude of the mechanical actuation signal and muscle actuation signal in view of the response information.

Another example of the present disclosure is an exoskeleton control method, which includes: detecting a neuronal action potential produced by a person to elicit a first muscle response from a body region of the user; transmitting a data signal representative of the neuronal action potential to a controller; in response to the data signal, transmitting an actuation signal from the controller to an actuation interface of an exoskeleton; wherein the actuation signal is configured to enhance, emulate, or emulate and enhance the first muscle response when applied to the actuation interface.

Another exemplary exoskeleton control method of the present disclosure includes any or all of the foregoing components, wherein the actuation signal comprises a muscle actuation signal and the actuation interface comprises a muscle actuation interface, the method further comprising: transmitting the muscle actuation signal from the controller to the muscle actuation interface, the muscle actuation signal configured to electrically stimulate at least one muscle in the body region; and stimulating the at least one muscle with the muscle actuation signal so as to produce a second muscle response in the body region, the second muscle response being proportional to the first muscle response.

Another exemplary exoskeleton control method of the present disclosure includes any or all of the foregoing components, the first muscle response includes at least one of flexion, extension, and rotation of the body region; and the second muscle response enhances, emulates, or enhances and emulates at least one of the flexion, extension, and rotation of the body region.

Another exemplary exoskeleton control method of the present disclosure includes any or all of the foregoing components, wherein the body region is a joint of a human body.

Another exemplary exoskeleton control method of the present disclosure includes any or all of the foregoing components, wherein the neuronal action potential comprises first and second neuronal signals targeting first and second muscles within the body region, the method further comprising: processing the data signal to distinguish the first and second neuronal signals and determine their respective muscular targets; transmitting first and second muscle actuation signals to first and second electrical communication pathways within the muscle actuation interface, the first and second electrical communication pathways being in electrical communication with the first and second muscles, respectively; wherein the first and second muscle actuation signals are configured to stimulate the first and second muscles and produce the second muscular response.

Another exemplary exoskeleton control method of the present disclosure includes any or all of the foregoing components, and further includes further: monitoring an actuation response from the at least one muscle, the actuation response indicative of a degree to which the at least one muscle responds to the stimulating with the muscle actuation potential; comparing the actuation response to a threshold value; and when the actuation response differs from the threshold value by greater than or equal to a predetermined amount, adjusting at least one of a power and amplitude of the muscle actuation signal until the actuation response equals the threshold value or differs from the threshold value by less than the predetermined amount.

Another exemplary exoskeleton control method of the present disclosure includes any or all of the foregoing components, and further includes applying a user profile to adjust at least one of a power and amplitude of the muscle actuation signal.

Another exemplary exoskeleton control method of the present disclosure includes any or all of the foregoing components, wherein the actuation signal comprises a mechanical actuation signal and the actuation interface comprises a mechanical actuator having at least one frame member coupled thereto, the method further comprising: transmitting the muscle actuation signal from the controller to the mechanical actuator; and in response to receiving the mechanical actuation signal, the mechanical actuator emulates the first muscle response with the at least one frame body.

Another exemplary exoskeleton control method of the present disclosure includes any or all of the foregoing components, wherein the body region is a joint of the person, the muscle response comprises at least one of flexion of the joint, extension the joint, rotation of the joint, or a combination thereof, and the mechanical actuator is operable in response to the mechanical actuation signal to emulate with the at least one frame member at least a portion of the flexion, the extension, the rotation, or the combination thereof.

Another exemplary exoskeleton control method of the present disclosure includes any or all of the foregoing components, wherein the body region is a knee, and the mechanical actuator is operable in response to the mechanical actuation signal to emulate with the at least one frame member at least one of flexion, extension, and rotation of the knee.

Another exemplary exoskeleton control method of the present disclosure includes any or all of the foregoing components, and further includes detecting response information indicative of a degree to which the muscles in the body region respond to the neuronal action potential; comparing the response information to a threshold value; when the response information is less than the threshold value, transmitting the mechanical actuation signal from the controller to the mechanical actuator; and when the response information is greater than or equal to the threshold value, not sending the mechanical actuation signal.

Another exemplary exoskeleton control method of the present disclosure includes any or all of the foregoing components, wherein: the actuation signal comprises at least one of a muscle actuation signal mechanical actuation signal and the actuation interface comprises a muscle actuation interface and a mechanical actuator having at least one frame member coupled thereto, the method further comprising: transmitting with the controller at least one of the muscle actuation signal to the muscle actuation interface and the mechanical actuation signal to the mechanical actuator; when the muscle actuation interface receives the muscle actuation signal, electrically stimulating the at least one muscle in the body region with the muscle actuation signal; and when the mechanical actuator receives the mechanical actuation signal, emulate at least a portion of the first muscle response with the at least one frame member.

Another exemplary exoskeleton control method of the present disclosure includes any or all of the foregoing components, wherein in response to the data signal, the controller transmits the muscle actuation signal and the mechanical actuation signal to the muscle actuation interface and the mechanical actuator, respectively.

Another exemplary exoskeleton control method of the present disclosure includes any or all of the foregoing components, wherein the data signal further comprises response information indicative of a degree to which muscles in the body region respond to the neuronal action potential, the method further comprising: comparing the response information to a threshold value; and adjusting at least one of a power and amplitude of at least one of the muscle actuation signal and the mechanical actuation signal if the response information differs from the threshold value by greater than or equal to a predetermined amount.

Another exemplary exoskeleton control method of the present disclosure includes any or all of the foregoing components, wherein the threshold value is a threshold muscle action potential value, the response information comprises a muscle action potential, and the method further comprises detecting the response information from the muscles in the body region.

Another exemplary exoskeleton control method of the present disclosure includes any or all of the foregoing components, wherein the predetermined value is greater than or equal to about +/−5% of the threshold muscle action potential value.

Another exemplary exoskeleton control method of the present disclosure includes any or all of the foregoing components, and further includes transmitting the mechanical actuation signals from the controller to the mechanical actuator when the muscle action potential detected from the muscles in the body region is less than the threshold muscle action potential value by greater than or equal to about 25%.

Another exemplary exoskeleton control method of the present disclosure includes any or all of the foregoing components, wherein the controller dynamically adjusts at least one of the power and amplitude of the mechanical actuation signal and muscle actuation signal in view of the response information.

Another example of the present disclosure is a controller for an exoskeleton system, which includes a processor; and a memory having exoskeleton control module (ECM) instructions stored thereon. The ECM instructions when executed cause the controller to perform the following operations comprising: transmit, in response to receiving a data signal indicative of a neuronal action potential produced by a person to elicit a first muscle response from a body region of the user, an actuation signal to an actuation interface of an exoskeleton, the actuation signal configured to enhance, emulate, or emulate and enhance the first muscle response when applied to the actuation interface.

Another exemplary controller for an exoskeleton system consistent with the present disclosure includes any or all of the foregoing components, wherein the actuation interface comprises a muscle actuation interface and the signal comprises a muscle actuation signal configured to electrically stimulate at least one muscle in the body region so as to produce a second muscle response in the body region, the second muscle response being proportional to the first muscle response.

Another exemplary controller for an exoskeleton system consistent with the present disclosure includes any or all of the foregoing components, wherein the neuronal action potential comprises a plurality of neuronal action potentials targeting different muscles within the body region, and the ECM instructions when executed further cause the controller to perform the following operations comprising: process the data signal to distinguish the plurality of neuronal action potentials from one another and to determine their respective muscular targets; generate a plurality of muscle actuation signals, wherein each muscle actuation signal corresponds to a respective neuronal action potential of the plurality of neuronal action potentials; and transmit the plurality of muscle actuation signals to the muscled actuation interface, such that each muscle actuation signal stimulates the muscular target of its corresponding neuronal action potential.

Another exemplary controller for an exoskeleton system consistent with the present disclosure includes any or all of the foregoing components, wherein the ECM instructions when executed further cause the controller to perform the following operations comprising: monitor an actuation response from the at least one muscle, the actuation response indicative of a degree to which the at least one muscle responds to stimulation with the muscle actuation signal; compare the actuation response to a threshold value; and when the actuation response differs from the threshold value by greater than or equal to a predetermined amount, adjust at least one of a power and amplitude of the muscle actuation signal until the actuation response equals the threshold value or differs from the threshold value by less than the predetermined amount.

Another exemplary controller for an exoskeleton system consistent with the present disclosure includes any or all of the foregoing components, wherein a user profile is stored in the memory, and the ECM instruction when executed further cause the controller to perform the following operations comprising: adjust at least one of a power and amplitude of the muscle actuation signal in view of at least one parameter in the user profile.

Another exemplary controller for an exoskeleton system consistent with the present disclosure includes any or all of the foregoing components, wherein the actuation signal comprises a mechanical actuation signal and the actuation interface comprises a mechanical actuator having at least one frame member coupled thereto, the ECM instructions when executed further cause the controller to perform the following operations comprising: transmit the muscle actuation signal to the mechanical actuator, so as to cause the mechanical actuator to emulates the first muscle response with the at least one frame member.

Another exemplary controller for an exoskeleton system consistent with the present disclosure includes any or all of the foregoing components, wherein the body region is a joint of the person, the first muscle response comprises at least one of flexion of the joint, extension the joint, rotation of the joint, or a combination thereof, and ECM instructions when executed further cause the controller to perform the following operations comprising: configure the mechanical actuation signal such that it is operable to cause the mechanical actuator to emulate with the at least one frame member at least a portion of the flexion, the extension, the rotation, or the combination thereof.

Another exemplary controller for an exoskeleton system consistent with the present disclosure includes any or all of the foregoing components, wherein the body region is a knee, and the ECM instructions when executed further cause the controller to perform the following operations comprising: configure the mechanical actuation signal such that it is operable to cause the mechanical actuator to emulate with the at least one frame member at least one of flexion, extension, and rotation of the knee.

Another exemplary controller for an exoskeleton system consistent with the present disclosure includes any or all of the foregoing components, wherein the ECM instructions when executed further cause the controller to perform the following operations comprising: compare response information indicative of a degree to which the muscles in the body region respond to the neuronal action potential to a threshold value; when the response information is less than the threshold value, transmit the mechanical actuation signal from the controller to the mechanical actuator; and when the response information is greater than or equal to the threshold value, not transmit the mechanical actuation signal.

Another exemplary controller for an exoskeleton system consistent with the present disclosure includes any or all of the foregoing components, wherein the actuation signal comprises at least one of a muscle actuation signal and a mechanical actuation signal, and the actuation interface comprises a muscle actuation interface and a mechanical actuator having at least one frame member coupled thereto, the ECM instructions when executed further cause the controller to perform the following operations comprising: transmit at least one of the muscle actuation signal to the muscle actuation interface and the mechanical actuation signal to the mechanical actuator, the muscle actuation signal operable to electrically stimulate the at least one muscle in the body region, the mechanical actuation signal operable to cause the mechanical actuator to emulate at least a portion of the first muscle response with the at least one frame member.

Another exemplary controller for an exoskeleton system consistent with the present disclosure includes any or all of the foregoing components, wherein the ECM instructions when executed further cause the controller to perform the following operations comprising: transmit, in response to receiving the data signal, the muscle actuation signal and the mechanical actuation signal to the muscle actuation interface and the mechanical actuator, respectively.

Another exemplary controller for an exoskeleton system consistent with the present disclosure includes any or all of the foregoing components, wherein the data signal further comprises response information indicative of a degree to which muscles in the body region respond to the neuronal action potential and the ECM instructions when executed further cause the controller to perform the following operations comprising: compare the response information to a threshold value; and when the response information differs from the threshold value by greater than or equal to a predetermined amount, adjust at least one of a power and amplitude of at least one of the muscle actuation signal and the mechanical actuation signal.

Another exemplary controller for an exoskeleton system consistent with the present disclosure includes any or all of the foregoing components, wherein the threshold value is a threshold muscle action potential value, the response information comprises a muscle action potential detected from muscles in the body region.

Another exemplary controller for an exoskeleton system consistent with the present disclosure includes any or all of the foregoing components, wherein the predetermined value is greater than or equal to about +/−5% of the threshold muscle action potential value.

Another exemplary controller for an exoskeleton system consistent with the present disclosure includes any or all of the foregoing components, wherein the ECM instructions when executed further cause the controller to perform the following operations comprising:

transmitting the mechanical actuation signal to the mechanical actuator when the muscle action potential detected from the muscles in the body region is less than the threshold muscle action potential value by greater than or equal to about 25%.

Another exemplary controller for an exoskeleton system consistent with the present disclosure includes any or all of the foregoing components, wherein the ECM instructions when executed further cause the controller to perform the following operations comprising: dynamically adjusting at least one of the power and amplitude of the mechanical actuation signal and muscle actuation signal in view of the response information.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims. Accordingly, the claims are intended to cover all such equivalents. Various features, aspects, and embodiments have been described herein. The features, aspects, and embodiments are susceptible to combination with one another as well as to variation and modification, as will be understood by those having skill in the art. The present disclosure should, therefore, be considered to encompass such combinations, variations, and modifications.

What is claimed is:

1. An exoskeleton system, comprising:

a sensor;

a controller;

a muscle actuation interface; and a mechanical actuator;

wherein:

said sensor is operable to detect, from a spinal column or a region proximate a joint of a person, a neuronal action potential produced by said person to elicit a first muscle response from at least one muscle in a body region of said person, and to transmit a data signal representative of said neuronal action potential to said controller, the data signal comprising response information indicative of a degree to which said at least one muscle responds to said neuronal action potential;

said controller is operable to receive said data signal, to compare said response information to a threshold value, and to determine whether to transmit at least one of a muscle actuation signal to said muscle actuation interface and a mechanical actuation signal to said mechanical actuator based at least in part on the comparison of said response information to said threshold value;

said controller is configured to only transmit said muscle actuation signal to said muscle actuation interface when said response information is less than said threshold value by more than a first predetermined amount;

when said response information is less than said threshold value by more than a second predetermined amount, said controller is configured to transmit only said mechanical actuation signal to said mechanical actuator or to transmit said mechanical actuation signal to said mechanical actuator and said muscle actuation signal to said muscle actuation interface, said second predetermined amount being greater than said first predetermined amount;

said muscle actuation interface is operable to electrically stimulate said at least one muscle with said muscle actuation signal, said muscle actuation signal configured to elicit a second muscular response of said body region that is proportional to said first muscular response; and said mechanical actuator is coupled to at least one frame member, and is operable in response to said mechanical actuation signal to emulate at least a portion of said first muscle response with said at least one frame member.

2. The exoskeleton system of claim 1, wherein:

said controller is further configured to adjust at least one of the power and amplitude of at least one of said muscle actuation signal and said mechanical actuation signal based at least in part on a degree of difference between said response information and said threshold value.

3. The exoskeleton system of claim 2, wherein:

said controller is configured to dynamically adjust at least one of a power and amplitude of said mechanical actuation signal and muscle actuation signal based at least in part on said response information.

4. The exoskeleton system of claim 1, wherein said threshold value is a threshold muscle action potential value, and said response information comprises a muscle action potential detected by said sensor from said muscles in said body region.

5. The exoskeleton system of claim 4, wherein said first predetermined amount is greater than or equal to about +/−5% of said threshold muscle action potential value.

6. The exoskeleton system of claim 5, wherein said first predetermined amount is greater than or equal to about 25% of said threshold muscle action potential value.

7. An exoskeleton control method, comprising:

detecting, from a spinal column or a region proximate a joint of a person, a neuronal action potential produced by said person to elicit a first muscle response from at least one muscle in a body region of said person;

stimulating, in response to detection of said neuronal action potential, said at least one muscle with a muscle actuation potential;

detecting response information from said at least one muscle, said response information indicative of a degree to which said at least one muscle responds to said stimulating with said muscle actuation potential;

transmitting a data signal to a controller, wherein the data signal includes said response information;

with said controller, comparing the response information to a threshold value and, based at least in part on that comparison, determining whether to transmit at least one of a muscle actuation signal to a muscle actuation interface of said exoskeleton or a mechanical actuation signal to a mechanical actuator of said exoskeleton;

wherein:

said determining results in only the transmission of said muscle actuation signal to said muscle actuation interface only when said response information is less than said threshold value by more than a first predetermined amount;

when said response information is less than said threshold value by more than a second predetermined amount, said determining results in the transmission of only said mechanical actuation signal to said mechanical actuator or the transmission of said mechanical actuation signal to said mechanical actuator and said muscle actuation signal to said muscle actuation interface, said second predetermined amount being greater than said first predetermined amount;

said muscle actuation interface is operable to electrically stimulate said at least one muscle with said muscle actuation signal to elicit a second muscle response from said body region, the second muscle response being proportional to the first muscle response; and said mechanical actuator is coupled to at least one frame member of said exoskeleton and is operable in response to said mechanical actuation signal to emulate at least a portion of said first muscle response with said at least one frame member.

8. The exoskeleton control method of claim 7, wherein:

said first muscle response includes at least one of flexion, extension, and rotation of said body region; and said second muscle response enhances, emulates, or enhances and emulates at least one of said flexion, extension, and rotation of said body region.

9. The exoskeleton control method of claim 8, wherein said body region is a joint of a human body.

10. The exoskeleton control method of claim 7, wherein said neuronal action potential comprises first and second neuronal signals targeting first and second muscles within said body region, the method further comprising:

processing said data signal to distinguish said first and second neuronal signals and determine their respective muscular targets;

transmitting first and second muscle actuation signals to first and second electrical communication pathways within said muscle actuation interface, said first and second electrical communication pathways being in electrical communication with said first and second muscles, respectively; wherein said first and second muscle actuation signals are configured to stimulate said first and second muscles and produce said second muscle response.

11. The exoskeleton control method of claim 7, further comprising applying a user profile to adjust at least one of a power and amplitude of said muscle actuation signal.

12. The exoskeleton control method of claim 7, wherein said body region is a joint of said person, said first muscle response comprises at least one of flexion of said joint, extension said joint, rotation of said joint, or a combination thereof, and said mechanical actuator is operable in response to said mechanical actuation signal to emulate with said at least one frame member at least a portion of said flexion, said extension, said rotation, or said combination thereof.

13. The exoskeleton control method of claim 12, wherein said body region is a knee, and said mechanical actuator is operable in response to said mechanical actuation signal to emulate with said at least one frame member at least one of flexion, extension, and rotation of said knee.

14. The exoskeleton control method of claim 7, wherein:

when said response information is greater than or equal to said threshold value, or is less than said threshold value by an amount less than said predetermined amount, said controller does not transmit said mechanical actuation signal.

15. The exoskeleton control method of claim 7, wherein said threshold value is a threshold muscle action potential value, and said response information comprises a detected muscle action potential.

16. The exoskeleton control method of claim 15, wherein said first predetermined value is greater than or equal to about +/−5% of said threshold muscle action potential value.

17. The exoskeleton control method of claim 7, wherein said first predetermined amount is greater than or equal to about 25% of said threshold value.

18. A controller for an exoskeleton system, comprising:

a processor; and a memory having exoskeleton control module (ECM) instructions stored thereon, wherein said ECM instructions when executed cause said controller to perform the following operations comprising:

detecting, from a spinal column or a region proximate a joint of a person, a neuronal action potential produced by said person to elicit a first muscle response from at least one muscle in a body region of said person;

in response to receipt of a data signal including response information indicative of a degree to which the at least one muscle in a body region of a person responds to said neuronal action potential, comparing the response information to a threshold value and, based at least in part on that comparison, determining whether to transmit at least one of a muscle actuation signal to a muscle actuation interface of said exoskeleton system and a mechanical actuation signal to a mechanical actuator of said exoskeleton;

wherein:

said determining results in only the transmission of said muscle actuation signal to said muscle actuation interface only when said response information is less than said threshold value by more than a first predetermined amount;

when said response information is less than said threshold value by more than a second predetermined amount, said determining results in the transmission of only said mechanical actuation signal to said mechanical actuator or the transmission of said mechanical actuation signal to said mechanical actuator and said muscle actuation signal to said muscle actuation interface, said second predetermined amount being greater than said first predetermined amount;

said muscle actuation interface is operable to electrically stimulate said at least one muscle with said muscle actuation signal to elicit a second muscle response from said body region, the second muscle response being proportional to the first muscle response; and said mechanical actuator is coupled to at least one frame member of said exoskeleton and is operable in response to said mechanical actuation signal to emulate at least a portion of said first muscle response with said at least one frame member.

19. The controller of claim 18, wherein said neuronal action potential comprises a plurality of neuronal action potentials targeting different muscles within said body region, and said ECM instructions when executed further cause said controller to perform the following operations comprising:

process said data signal to distinguish said plurality of neuronal action potentials from one another and to determine their respective muscular targets;

generate a plurality of muscle actuation signals, wherein each muscle actuation signal corresponds to a respective neuronal action potential of said plurality of neuronal action potentials; and transmit said plurality of muscle actuation signals to said muscled actuation interface, such that each muscle actuation signal stimulates the muscular target of its corresponding neuronal action potential.

20. The controller of claim 18, wherein a user profile is stored in said memory, and said ECM instructions when executed further cause said controller to perform the following operations comprising:

adjust at least one of a power and amplitude of said muscle actuation signal in view of at least one parameter in said user profile.

21. The controller of claim 18, wherein said body region is a joint of said person, said first muscle response comprises at least one of flexion of said joint, extension said joint, rotation of said joint, or a combination thereof, and ECM instructions when executed further cause said controller to perform the following operations comprising:

configure said mechanical actuation signal such that it is operable to cause said mechanical actuator to emulate with said at least one frame member at least a portion of said flexion, said extension, said rotation, or said combination thereof.

22. The controller of claim 21, wherein said body region is a knee, and said ECM instructions when executed further cause said controller to perform the following operations comprising:

configure said mechanical actuation signal such that it is operable to cause said mechanical actuator to emulate with said at least one frame member at least one of flexion, extension, and rotation of said knee.

23. The controller of claim 18, wherein said threshold value is a threshold muscle action potential value, said response information comprises a muscle action potential detected from said at least one muscle.

24. The controller of claim 23, wherein said predetermined amount is greater than or equal to about +/−5% of said threshold muscle action potential value.

25. The controller of claim 18, wherein said predetermined amount is greater than or equal to about 25% of said threshold value.

* * * * *